US011739889B2

(12) United States Patent
Hong et al.

(10) Patent No.: US 11,739,889 B2
(45) Date of Patent: Aug. 29, 2023

(54) LAMP BASE HOLDER, LAMP, AND METHOD FOR ADJUSTING ANGLE OF LAMP BODY

(71) Applicant: MATIC LIGHTING TECHNOLOGY(SHANGHAI) CO., LTD., Shanghai (CN)

(72) Inventors: Kian-Cheong Hong, Shanghai (CN); Qingwu Mao, Shanghai (CN)

(73) Assignee: MATIC LIGHTING TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/958,451

(22) Filed: Oct. 3, 2022

(65) Prior Publication Data

US 2023/0118442 A1 Apr. 20, 2023

(30) Foreign Application Priority Data

Oct. 15, 2021 (CN) ..... 202111201731.9

(51) Int. Cl.
*F21K 9/27* (2016.01)
*F21V 23/06* (2006.01)

(52) U.S. Cl.
CPC ..... *F21K 9/27* (2016.08); *F21V 23/06* (2013.01)

(58) Field of Classification Search
CPC ..... F21K 9/27; F21V 23/06
See application file for complete search history.

(56) References Cited

U.S. PATENT DOCUMENTS

2012/0106177 A1* 5/2012 Blankestijn ..... F21V 19/04 362/382
2014/0273644 A1* 9/2014 McSweyn ..... H01R 31/06 439/628
2016/0209017 A1* 7/2016 Feller ..... F21S 8/00

FOREIGN PATENT DOCUMENTS

CN 104595809 5/2015
CN 107940407 A * 4/2018 ..... F21V 17/12
CN 211475614 9/2020
CN 111998261 11/2020
WO 2021082737 5/2021

OTHER PUBLICATIONS

English translation of Shen CN-107940407-A, published Apr. 2018 (Year: 2018).*

* cited by examiner

*Primary Examiner* — Evan P Dzierzynski
(74) *Attorney, Agent, or Firm* — JCIPRNET

(57) ABSTRACT

A lamp base holder, a lamp, and a method for adjusting an angle of a lamp body are provided. The lamp base holder includes a lamp base neck, a lamp cap, and a fixing pin. The fixing pin penetrates the lamp base neck and the lamp cap. The lamp base neck is provided with a first circuit board and a second circuit board. The first circuit board is provided with a first conductive region. The second circuit board is provided with a second conductive region. A first propping pin is connected to the lamp cap or the fixing pin. One end of the first propping pin is constantly abutted against the first conductive region. A second propping pin is further connected to the lamp cap or the fixing pin. One end of the second propping pin is constantly abutted against the second conductive region.

20 Claims, 15 Drawing Sheets

A-A

LAMP BASE HOLDER, LAMP, AND METHOD FOR ADJUSTING ANGLE OF LAMP BODY

CROSS-REFERENCE TO RELATED APPLICATION

This application claims priority to China Application serial No. 202111201731.9, filed on Oct. 15, 2021, which is hereby incorporated by reference in its entirety.

BACKGROUND

Technical Field

The present application relates to the technical field of illumination devices, and in particular, relates to a lamp base holder, a lamp, and a method for adjusting an angle of a lamp body.

Description of Related Art

A lamp base holder is an assembly for connecting a lamp socket and a lamp body, such that a lamp body is electrically connected to the lamp socket and is thus capable of emitting light. Since a light-emitting diode (LED) light source usually emits light in a single and planar direction, after an LED lamp body is tightened and mounted on the lamp base holder, a problem is present with respect to the direction of a light-emitting surface. That is, the light-emitting surface may not be regularly adjusted after the lamp base is tightened and mounted at the lamp base holder, and in addition, a conductive wire is affected during rotation, for example, twisting or break of the conductive wire.

Accordingly, how to cause the lamp body to be rotatable to any desired direction after the lamp body is mounted on the lamp base holder is a problem to be urgently solved in the industry.

SUMMARY

Embodiments of the present application provide a lamp base holder, a lamp, and a method for adjusting an angle of a lamp body, such that the lamp body may be rotated to any desired direction without affecting a conductive wire even in the case that the lamp body is fastened to the lamp base holder.

According to a first aspect of the embodiments of the present application, a lamp base holder is provided. The lamp base holder includes a lamp base neck, a lamp cap, and a fixing pin.

The lamp cap is configured to mount a lamp body, and the fixing pin penetrates the lamp base neck and the lamp cap to connect the lamp base neck to the lamp cap and is configured to cause the lamp cap to rotate relative to the lamp base neck, The lamp base neck includes a bottom plate and a side wall surrounding a circumference of the bottom plate, the bottom plate is arranged opposite to the lamp cap, and the side wall is configured to be connected to a lamp socket, The lamp base neck is provided with a first circuit board and a second circuit board, the first circuit board is arranged on a side, facing the lamp cap, of the bottom plate, and the second circuit board is arranged on a side, distal from the lamp cap, of the bottom plate, The first circuit board is provided with a first conductive region and the second circuit board is provided with a second conductive region, the first circuit board is connected to a first wiring via the first conductive region, and the second circuit board is connected to a second wiring via the second conductive region, one of the first wiring and the second wiring is configured to be connected to an L wire of a power source, and the other one of the first wiring and the second wiring is connected to an N wire of the power source, such that the lamp body is connected to circuitry to cause the lamp body to be capable of emitting light.

The lamp cap is provided with a first propping pin. One end of the first propping pin is electrically connected to the lamp body, and the other end of the first propping pin penetrates the lamp cap and is configured to be electrically connected to the first conductive region, the first propping pin is rotatable with the lamp cap, and in a process of rotation of the lamp cap relative to the lamp base neck, the other end of the first propping pin is constantly abutted against the first conductive region.

The fixing pin is internally provided with a second propping pin along an axis of the fixing pin, one end of the second propping pin is electrically connected to the lamp body, and the other end of the second propping pin protrudes from the fixing pin and is configured to be electrically connected to the second conductive region, and in the process of rotation of the lamp cap relative to the lamp base neck, the other end of the second propping pin is constantly abutted against the second conductive region.

In some embodiments, at least one of the first conductive region and the second conductive region is circular or annular, and circle centers of the first conductive region and the second conductive region are disposed on the axis of the fixing pin.

In some embodiments, the second circuit board is provided with an escape opening allowing the first wiring to penetrate.

In some embodiments, the first circuit board is provided with a connection hole configured to be connected to the first wiring, and the lamp base neck is provided with a locating block, the second circuit board is provided with a locating slot, and the locating slot is engaged with the locating block such that the escape opening is in communication with the connection hole in the first circuit board.

In some embodiments, the lamp base neck further includes an inner ring disposed on an inner side of the side wall and an annular slot disposed between the inner ring and the side wall. The inner ring is disposed on a side, proximal to the lamp cap, of the bottom plate, the inner ring is provided with an inner bore, the inner bore extends through the inner ring and the bottom plate, the first circuit board is disposed in the annular slot, and the inner bore of the inner ring is configured to allow the fixing pin to be inserted therein.

In some embodiments, the lamp cap includes a housing portion and a columnar portion. The housing portion is configured to accommodate the lamp body, the columnar portion protrudes from an outer wall of the housing portion, a through hole is disposed at a center of the columnar portion, and an outer wall of the columnar portion is engaged with an inner wall of the side wall, and the through hole is engaged with an outer wall of the inner ring.

In some embodiments, the housing portion is provided with a toothed ring surrounding the columnar portion, and an end portion of the side wall is abutted against the toothed ring. The toothed ring is provided with a turn of end-face teeth, and the end portion of the side wall is provided with a restraining block, and the restraining block is engaged with the end-face teeth to lock a rotation angle of the lamp cap relative to the lamp base neck.

In some embodiments, a periphery of the columnar portion is provided with a turn of lamp cap locking teeth, and an inner wall of the side wall is provided with lamp base locking teeth. The lamp base locking teeth are meshed with the lamp cap locking teeth such that a rotation angle of the lamp cap relative to the lamp base neck is locked.

In some embodiments, an outer peripheral surface of the columnar portion is fitted, via a tapered surface, with an inner peripheral surface of the side wall. A smaller-diameter end of the tapered surface is proximal to the lamp base neck, a larger-diameter end of the tapered surface is proximal to the lamp cap, and the lamp cap locking teeth and the lamp base locking teeth both extend along a generatrix of the tapered surface.

In some embodiments, the fixing pin includes a post portion, a first stop portion disposed on one end of the post portion, and a second stop portion disposed on the other end of the post portion. The first stop portion and the second stop portion both protrude from an outer periphery of the post portion, the post portion penetrates the inner bore of the inner ring, the first stop portion is disposed on an end, distal from the lamp cap, of the inner bore of the inner ring, and the second stop portion is disposed on an end, distal from the lamp base neck, of the through hole.

In some embodiments, the lamp base holder further includes an elastic washer. The elastic washer is disposed between the fixing pin and the lamp base neck, and is in elastic contact with the fixing pin and the lamp base neck.

In some embodiments, the elastic washer is a wave washer.

In some embodiments, at least one of a surface, in contact with the fixing pin, of the elastic washer, and a surface, in contact with the lamp base neck, of the elastic washer is provided with an anti-skid pattern.

In some embodiments, a locking mechanism is disposed between the fixing pin and the lamp cap, and is configured to cause the fixing pin to rotate with the lamp cap.

In some embodiments, the locking mechanism includes a boss disposed on the lamp cap and a recess disposed on an edge of the first stop portion. The recess is fitted with the boss.

In some embodiments, the first propping pin includes a first section and a second section that are coaxially connected. A conductive elastic member is disposed between the first section and the second section.

In some embodiments, the lamp base holder further includes a conductive fixing sleeve. The first propping pin is mounted in the fixing sleeve, and the first propping pin is electrically connected to the lamp body via the fixing sleeve.

In some embodiments, an end portion surface, in contact with the first conductive region, of the first propping pin is designed as a smooth curved surface.

According to a second aspect of the embodiments of the present application, a lamp is provided. The lamp includes a lamp base, a lamp body, and the lamp base holder as described above.

An exterior of the side wall of the lamp base neck of the lamp base holder is provided with male threads.

The lamp base is provided with male threads and female threads. The male threads are engaged with a lamp socket to receive power, and the female threads are engaged with the male threads of the lamp base neck.

The lamp body is fixed to the lamp cap of the lamp base holder.

According to a third aspect of the embodiments of the present application, a method for adjusting an angle of a lamp body, applicable to the lamp as described above. The method includes the following steps.

Rotating the lamp cap about the axis of the fixing pin, such that the lamp body, the first propping pin, and the second propping pin rotate with the lamp cap, and in the process of rotation of the lamp cap relative to the lamp base neck, one end of the first propping pin is constantly abutted against the first conductive region, and the other end of the second propping pin is constantly abutted against the second conductive region.

According to the embodiments of the present application, a lamp base neck and a lamp cap that are rotatable relative to each other are disposed, a first circuit board and a second circuit board are disposed on the lamp base neck, the first circuit board is provided with a first conductive region, the second circuit board is provided with a second conductive region, a first propping pin and a second propping pin that are configured to be rotatable with the lamp cap, the first propping pin is abutted against the first conductive region to achieve electrical connection, the second propping pin is abutted against the second conductive region to achieve electrical connection. In this way, the lamp cap is rotatable to any desired angle relative to the lamp base neck to adjust an angle of a lamp body, and no conductive wire needs to be used between the lamp cap and the lamp base neck, such that twisting and break of the conductive wire are prevented in the process of rotation of the lamp cap.

The above description only summarizes the technical solutions of the embodiments of the present application. Specific embodiments of the present application are described hereinafter to better and clearer understand the technical solutions of the embodiments of the present application, to practice the technical solutions based on the disclosure of the specification and to make the above and other objectives, features and advantages of the embodiments of the present application more apparent and understandable.

BRIEF DESCRIPTION OF THE DRAWINGS

To describe the technical solutions in the embodiments of the present application more clearly, the following briefly describes the accompanying drawings required for describing the embodiments. Apparently, the accompanying drawings in the following description show some embodiments of the present application, and persons of ordinary skill in the art may still derive other drawings from these accompanying drawings without creative efforts.

DESCRIPTION OF THE EMBODIMENTS

Figure 1:
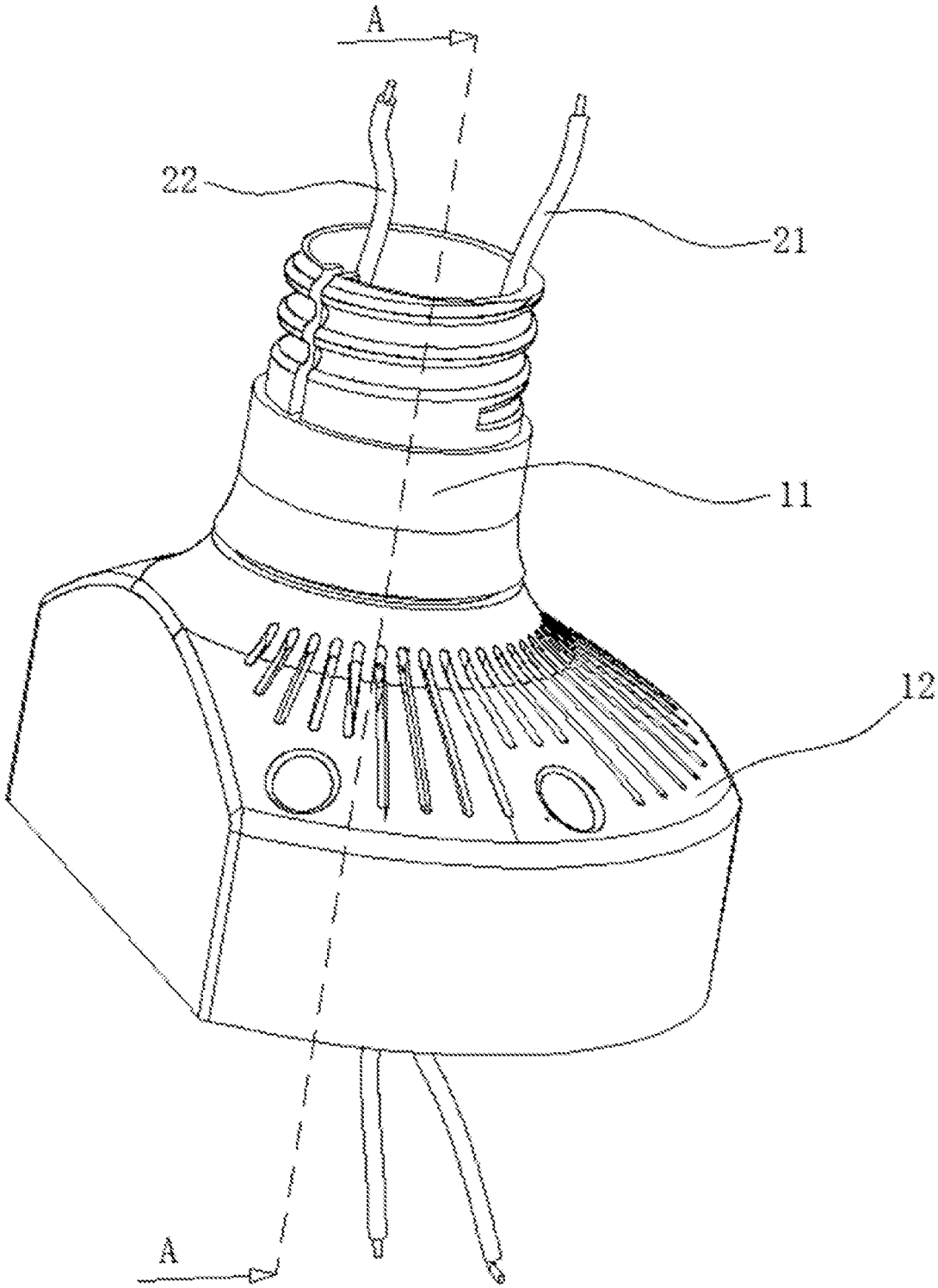
FIG. 1 is a schematic overall structural view of a lamp base holder according to an embodiment of the present application.

To make the objectives, technical solutions, and advantages of the embodiments of the present application clearer, the following clearly describes the technical solutions in the embodiments of the present application with reference to the accompanying drawings in the embodiments of the present application. Apparently, the described embodiments are some but not all of the embodiments of the present application. All other embodiments obtained by a person of ordinary skill in the art based on the embodiments of the present application without creative efforts shall fall within the protection scope of the present application.

Unless otherwise defined, all the technical and scientific terms used in this specification convey the same meanings as the meanings commonly understood by a person skilled in the art to which the present application pertains. The terms used in this specification are only intended to illustrate the specific embodiments of the present application, instead of limiting the present application.

The terms "comprise," "include," and variations thereof in the specification, claims and accompanying drawings are intended to define a non-exclusive meaning. The word "a" or "an" used before a module does not exclude the presence of a plurality of such modules.

The term "embodiment" in this specification signifies that the specific characteristics, structures or features described with reference to the embodiments may be covered in at least one embodiment of the present application. This term "embodiment," when used in various positions of the description, neither indicates the same embodiment, nor indicates an independent or optional embodiment that is exclusive of the other embodiments. A person skilled in the art would implicitly or explicitly understand that the embodiments described in this specification may be incorporated with other embodiments.

The words indicative of orientations or directions hereinafter are all directions indicated in the drawings, but are not intended to limit the specific structures of the lamp base holder and the lamp according to the present application. For example, in the description of the present application, a direction or a positional relationship indicated by the terms such as "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," and "circumferential" is a direction or positional relationship based on the illustration in the drawings, and is merely intended for ease or brevity of description of this application, but not intended to indicate or imply that the indicated device or component should be located in the specified direction or constructed or operated in the specified direction. Therefore, such terms are not to be understood as a limitation on this application.

Terms such as "first," "second," and the like in the specifications, claims and the accompanying drawings of the present application are intended to distinguish different objects but are not intended to define a specific sequence. Such terms may explicitly or implicitly indicate one or more such features.

In the description of the embodiments of the present application, the term "multiple" or "a plurality of" signifies at least two (including two), unless otherwise specified. Likewise, the term "a plurality of groups" or "multiple groups" signifies at least two groups (including two groups).

In the description of the present application, it should be noted that unless otherwise specified, the terms "mounted," "coupled," "connected," and derivative forms of these words shall be understood in a broad sense, which, for example, may be understood as physical connection. For example, the physical connection may include: fixed connection by fixing members such as connection by screws, bolts or the other fixing members; detachable connection such as snap-fitting or engagement connection; or integral connection such as connection by welding, soldering, bonding, or integral modeling. Persons of ordinary skill in the art may understand the specific meanings of the above terms in the present application according to the actual circumstances and contexts.

An LED light source is generally a plane-type device capable of emitting light in a single direction. Therefore, in the case that an LED lamp body is fastened to a lamp base holder, how to rotate the lamp body to a desired direction is a problem to be urgently solved in the industry.

In the related art, the lamp base holder for mounting the lamp body is manufactured into an assembly, and at least two parts of the assembly may be rotatable relative to each other, such that the lamp body is rotated to the desired angle.

However, since the lamp body and the lamp socket need to be electrically connected and the electrical connection is achieved by a conductive wire, in the process of relative rotation of the two parts of the assembly, the conductive wire may be inevitably twisted, interwind, or even broken, such that the lamp base holder fails to be normally used.

Figure 2:
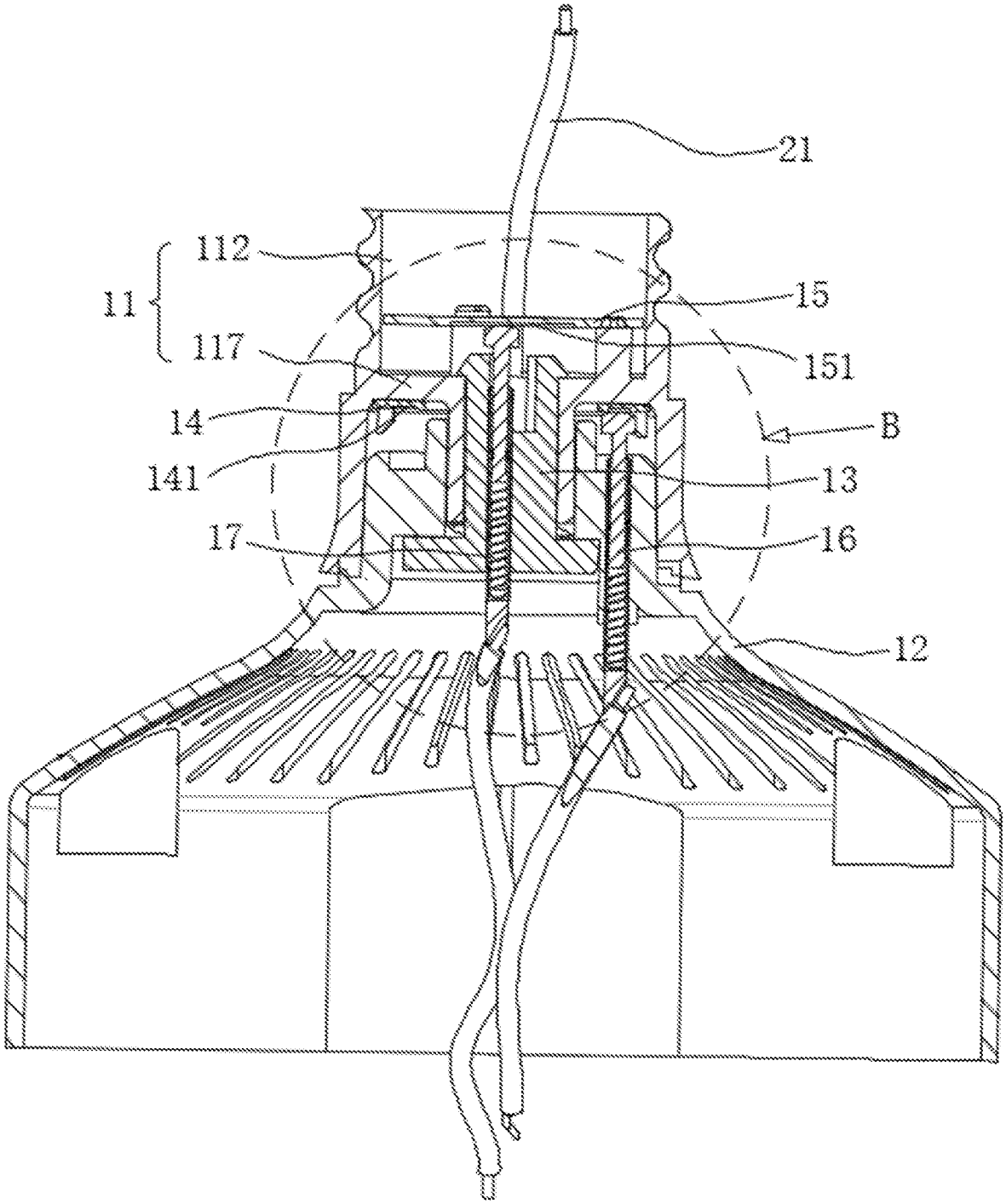
FIG. 2 is a schematic sectional view taken along an A-A side in FIG. 1.
Figure 3:
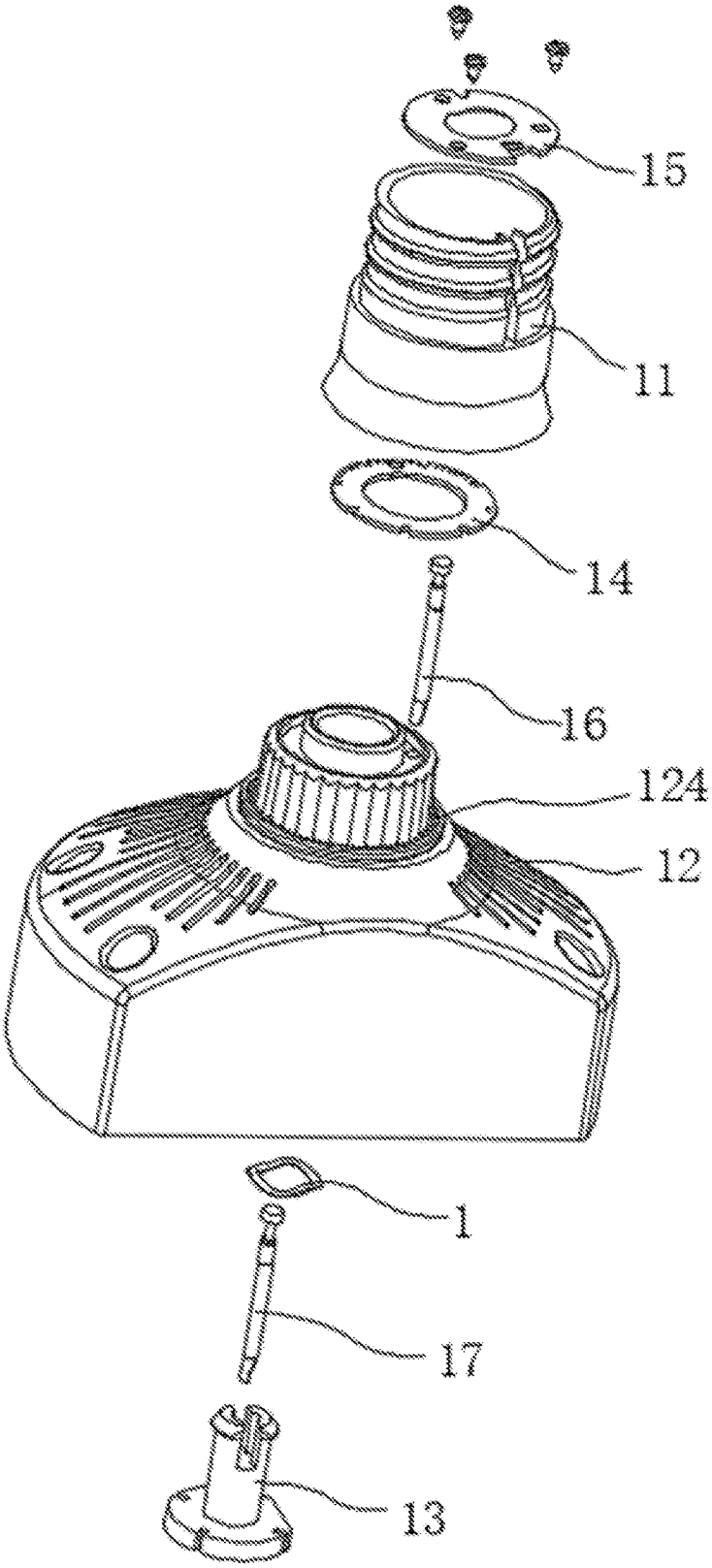
FIG. 3 is a schematic exploded view of the lamp base holder according to an embodiment of the present application.

To solve the above technical problem, an embodiment of the present application provides a lamp base holder 01. FIG. 1 is a schematic overall structural view of the lamp base holder 01, FIG. 2 is a schematic sectional view taken along an A-A side in FIG. 1, and FIG. 3 is a schematic exploded view of the lamp base holder 01. As illustrated in FIG. 1, FIG. 2, and FIG. 3, the lamp base holder 01 includes a lamp base neck 11, a lamp cap 12, and a fixing pin 13. The lamp cap 12 is configured to mount the lamp body 03. The fixing pin 13 penetrates the lamp base neck 11 and the lamp cap 12, and is connected to the lamp base neck 11 and the lamp cap 12, such that the lamp cap 12 is rotatable relative to the lamp base neck 11. For example, the fixing pin 13 successively penetrates the lamp base neck 11 and the lamp cap 12, such that the lamp base neck 11 and the lamp cap 12 are rotatable respectively about an axis of the fixing pin 13, or one of the lamp base neck 11 and the lamp cap 12 is fixed relative to the fixing pin 13, and the other of the lamp base neck 11 and the lamp cap 12 is rotatable about the fixing pin 13. In this way, relative rotation between the lamp base neck 11 and the lamp cap 12 is achieved.

The fixing pin 13 may penetrate the lamp base neck 11 and the lamp cap 12 in a plurality of fashions. For example, projections, along a direction perpendicular to the axis of the fixing pin 13, of the lamp base neck 11 and the lamp cap 12 respectively correspond to different positions of the axis of the fixing pin 13. That is, the fixing pin 13, in an axial direction thereof, successively penetrates the lamp base neck 11 and the lamp cap 12. Alternatively, projections, along a direction perpendicular to the axis of the fixing pin 13, of the lamp base neck 11 and the lamp cap 12 are at least partially overlapped. For example, the lamp base neck 11 partially or totally penetrates the lamp cap 12, and the fixing pin 13 directly penetrates the lamp base neck 11 and hence indirectly penetrates the lamp cap 12. This structure is as illustrated in FIG. 2.

As illustrated in FIG. 2, the lamp base neck 11 includes a bottom plate 117 and a side wall 112 surrounding a circumference of the bottom plate 117. The bottom plate 117 is arranged opposite to the lamp cap 12, and the side wall 112 is configured to be connected to a lamp socket.

As illustrated in FIG. 2 and FIG. 3, the lamp base neck 11 is provided with a first circuit board 14 and a second circuit board 15. The first circuit board 14 is arranged on a side, facing the lamp cap 12, of the bottom plate 117, and the second circuit board 15 is arranged on a side, distal from the lamp cap 12, of the bottom plate 117.

Figure 4:
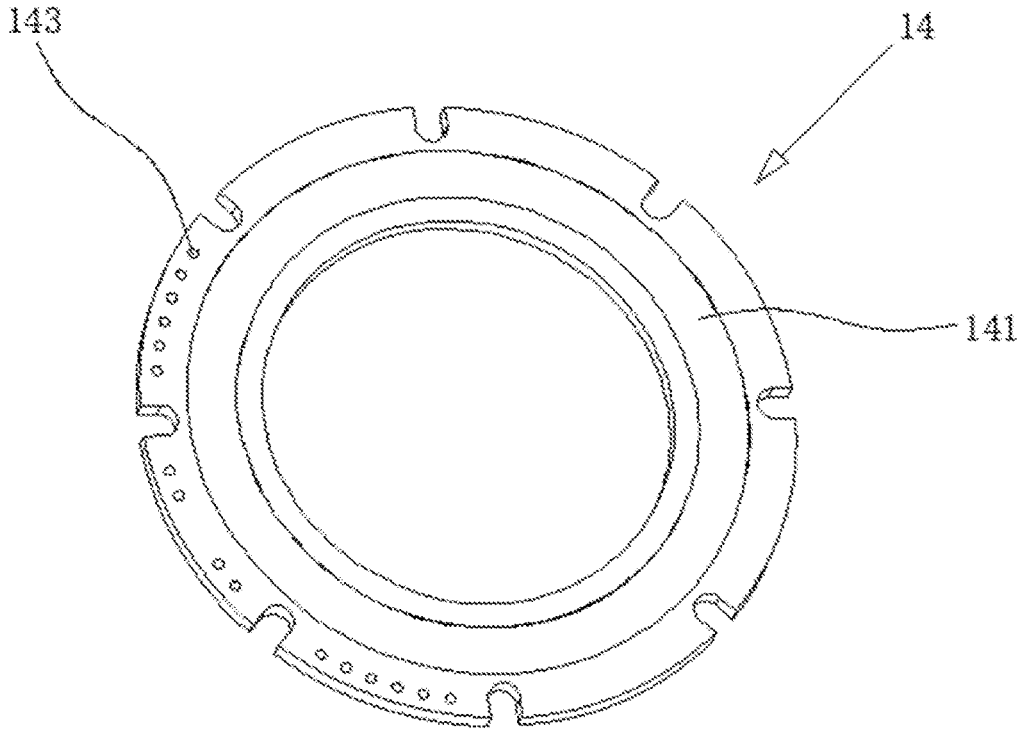
FIG. 4 is a schematic structural view of a first circuit board at a first view angle according to an embodiment of the present application.
Figure 5:
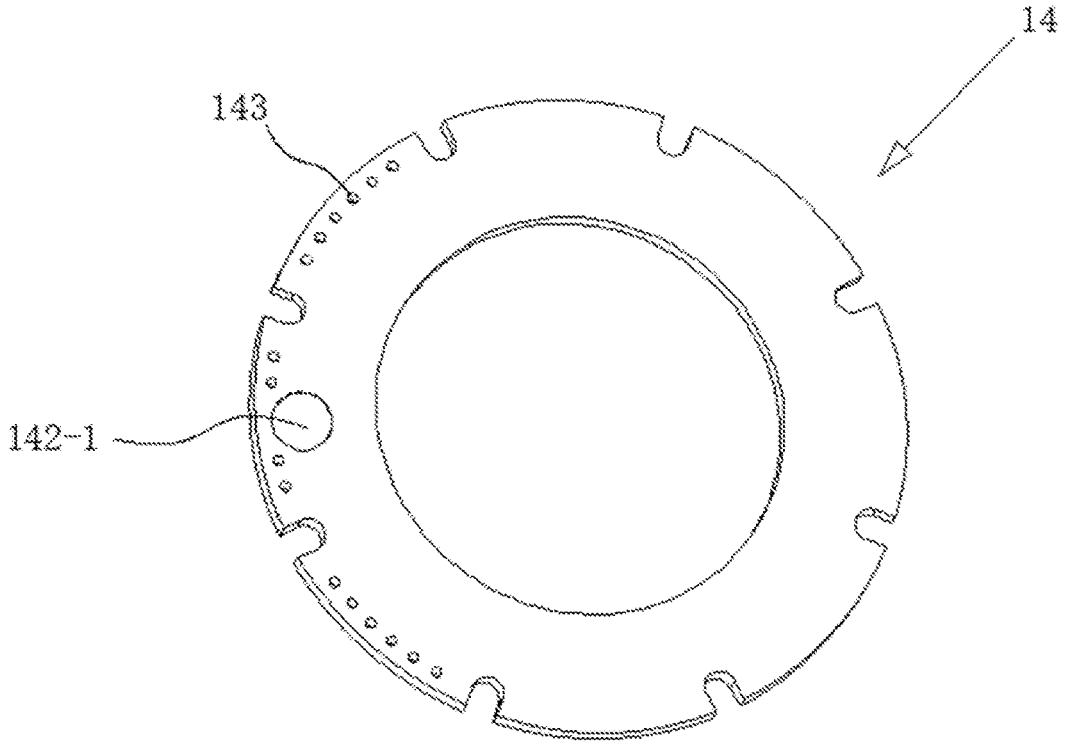
FIG. 5 is a schematic structural view of the first circuit board at a second view angle according to an embodiment of the present application.

The structure of the first circuit board 14 is as illustrated in FIG. 4 and FIG. 5. The shape of the first circuit board 14 is annular, and the first circuit board 14 is provided with an annular first conductive region 141. In the process of assembling of the first circuit board 14, a circle center of the first conductive region 141 is substantially coincident with the axis of the fixing pin 13, and the first circuit board 14 is connected to a first wiring 21 via the first conductive region 141 (as illustrated in FIG. 1).

The first circuit board 14 is provided with a tooling hole 143. The tooling hole 143 extends through the first circuit board 14. Hole metallization treatment is performed for the tooling hole 143, such that a current is conducted between two sides of the first circuit board 14.

Figure 6:
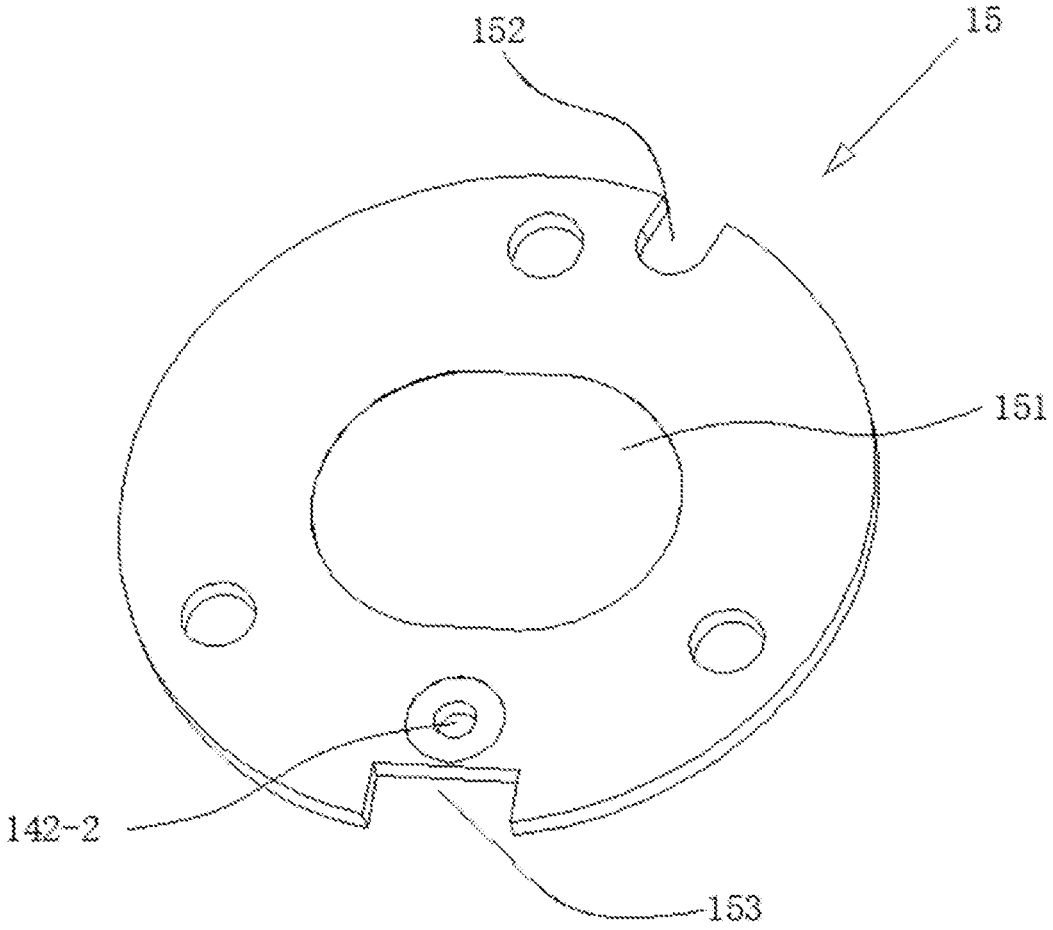
FIG. 6 is a schematic structural view of a second circuit board according to an embodiment of the present application.

The structure of the second circuit board 15 is as illustrated in FIG. 6. In this embodiment of the present application, the second circuit board 15 is circular, and the second circuit board 15 is provided with a second conductive region 151. The second conductive region 151 is elliptical. The second circuit board 15 is connected to a second wiring 22 via the second conductive region 151 (as illustrated in FIG. 1).

The first wiring 21 is configured to be connected to an N wire (or a null wire) of a power source, and the second wiring 22 is configured to be connected to an L wire (or a live wire) of the power source. Alternatively, the first wiring 21 is configured to be connected to the L wire of the power source, and the second wiring 22 is configured to be connected to the N wire of the power source, such that the lamp body 03 is powered on and emits light.

As illustrated in FIG. 2 and FIG. 3, a first propping pin 16 is connected to the lamp cap 12. One end of the first propping pin 16 is configured to be electrically connected to the lamp body 03, and the other end of the first propping pin 16 penetrates the lamp cap 12 and is configured to be electrically connected to the first conductive region 141 of the first circuit board 14. For example, the first conductive region 141 is a metal layer, for example, a copper layer or an aluminum layer, the first propping pin 16 and the first conductive region 141 are electrically connected by means of metal contact, the first propping pin 16 rotates with the lamp cap 12, and in the process of rotation of the lamp cap 12 relative to the lamp base neck 11, the other end of the first propping pin 16 is constantly abutted against the first conductive region 141, that is, the first propping pin 16 and the first conductive region 141 are constantly in metal contact to achieve electrical connection therebetween.

As illustrated in FIG. 2 and FIG. 3, a second propping pin 17 is disposed inside the fixing pin 13 along an axis of the fixing pin 13. One end of the second propping pin 17 is configured to be electrically connected to the lamp body 03, and the other end of the second propping pin 17 protrudes from the fixing pin 13 and is configured to be electrically connected to the second conductive region 151 of the second circuit board 15. For example, the second conductive region 151 is a metal layer, for example, a copper layer or an aluminum layer, the second propping pin 17 and the second conductive region 151 are electrically connected by means of metal contact, the second propping pin 17 rotates with the lamp cap 12, and in the process of rotation of the lamp cap 12 relative to the lamp base neck 11, the other end of the second propping pin 17 is constantly abutted against the second conductive region 151, that is, the second propping pin 17 and the second conductive region 151 are constantly in metal contact to achieve electrical connection.

According to the above embodiment, the first propping pin 16 is abutted against the first conductive region 141 such that the first propping pin 16 is electrically connected to the first wiring 21, and the second propping pin 17 is abutted against the second conductive region 151 such that the second propping pin 17 is electrically connected to the second wiring 22. In the case that the first propping pin 16 and the second propping pin 17 are connected to the lamp body, the lamp body may be connected to the circuit constituted by the first wiring 21 and the second wiring 22, such that the lamp body 03 is capable of emitting light. In this way, no conductive wire is needed between the lamp base neck 11 and the lamp cap 12. When an angle of the lamp body needs to be adjusted, the lamp cap 12 is rotated, and rotation of the lamp cap 12 drives the lamp body 03, the first propping pin 16, and the second propping pin 17 to rotate simultaneously. The first propping pin 16 is abutted against the first conductive region 141 in the process of rotation, and the second propping pin 17 is abutted against the second conductive region 151 in the process of rotation. By the abutment, in the case that the lamp cap 12 is rotated to any angle and position, the lamp body 03 is constantly connected to the circuit, and thus the problem of twisting and break of the conductive wire is addressed.

In some embodiments, the first propping pin 16 and the second propping pin 17 substantially have the same structure. For ease of description, the embodiment hereinafter is described only using the structure of the first propping pin 16 as an example.

Figure 7:
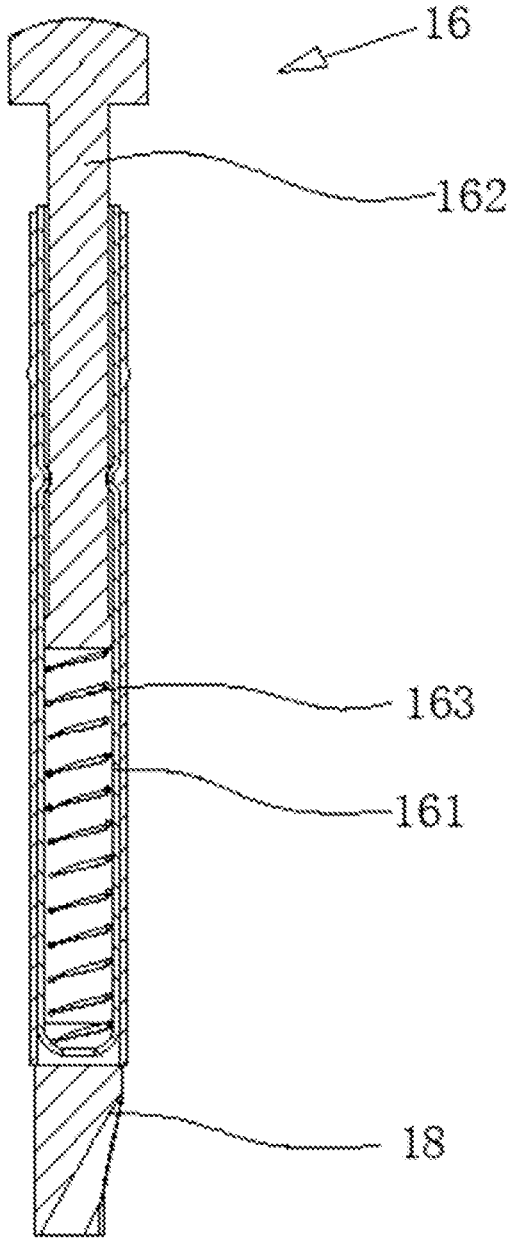
FIG. 7 is a schematic sectional view of a first propping pin according to an embodiment of the present application.
Figure 8:
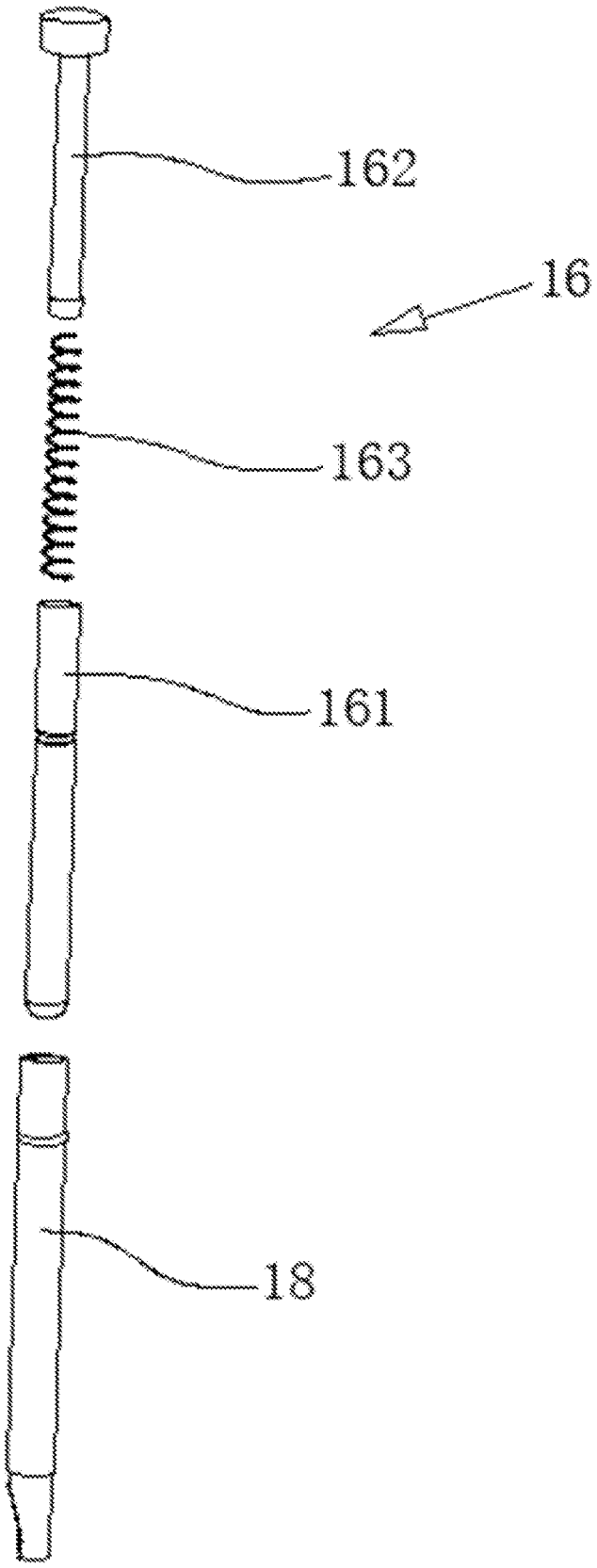
FIG. 8 is a schematic exploded view of the first propping pin according to an embodiment of the present application.

As illustrated in FIG. 7 and FIG. 8, FIG. 7 is a schematic sectional view of the first propping pin 16, and FIG. 8 is a schematic exploded view of the first propping pin 16. In some embodiments, the first propping pin 16 is telescopically disposed along the axis thereof. Exemplarily, the first propping pin 16 includes a first section 161 and a second section 162 that are coaxially connected. A conductive elastic member 163 is disposed between the first section 161 and the second section 162. For example, the elastic member 163 may be a metal spring, a metal elastic sheet, or the like. By telescoping of the elastic member 163, the first section 161 and the second section 162 moves close to or away from each other. In this way, the first propping pin 16 is telescopic along the axis thereof.

As illustrated in FIG. 7 and FIG. 8, in some embodiments, the first section 161 is hollow tubular, and a top of the first section 161 is provided with an opening, and a bottom of the first section 161 is closed. The elastic member 163 is mounted in a tube pore of the first section 161. One end of the second section 162 is inserted into the tube pore of the first section 161 and abutted against the elastic member 163, and the other end of the second section 162 is abutted against the first conductive region 141.

By configuring the first propping pin 16 to the above structure, in the case that the first propping pin 16 is mounted on the lamp base holder 01 when the elastic member 163 is in a compressed state, under effect of the elastic member 163, the second section 162 is tightly abutted against the first conductive region 141, such that in the process of rotation of the first propping pin 16, an end portion of the first propping pin 16 may not easily detach from the first conductive region 141, thereby ensuring stability of electrical connection. Further, by this configuration, a length of the first propping pin 16 may vary with a compression degree of the elastic member 163, such that the first propping pin 16 is adaptive to different mounting spaces.

As illustrated in FIG. 7 and FIG. 8, in some embodiments, an end portion surface, in contact with the first conductive region 141, of the first propping pin 16 is designed as a smooth curved surface to reduce friction between the first propping pin 16 and the surface of the first conductive region 141 in the process of rotation.

As illustrated in FIG. 7 and FIG. 8, in some embodiments, the lamp base holder 01 further includes a conductive fixing sleeve 18. The first propping pin 16 is mounted in the fixing sleeve 18. The fixing sleeve 18 is configured to be electrically connected to the lamp body 03, such that the first propping pin 16 is electrically connected to the lamp body 03. Exemplarily, the fixing sleeve 18 is tubular, and one end of the fixing sleeve 18 is provided with an opening. The first propping pin 16 may be mounted from the opening. A positioning mechanism may be disposed between the fixing sleeve 18 and the first propping pin 16. For example, the positioning mechanism includes a protrusion disposed on an inner wall of the fixing sleeve 18 and a recess disposed on an outer wall of the first section 161. In the process of the process of mounting the first propping pin 16 into the fixing sleeve 18, in the case that the protrusion is engaged with the recess, it is difficult for the first propping pin 16 and the fixing sleeve 18 to move relative to each other, such that the first propping pin 16 and the fixing sleeve 18 are positioned and restrained. Likewise, engagement between the fixing sleeve 18 and the lamp cap 12 may also be achieved by this positioning mechanism, which is not limited in the embodiments of the present application.

In the process of mounting, the fixing sleeve 18 is first mounted on the lamp cap 12, such that the end, provided with the opening, of the fixing sleeve 18 is proximal to the lamp base neck 11, and then the first propping pin 16 is mounted from the opening of the fixing sleeve 18 into the fixing sleeve 18. During use, the fixing sleeve 18 and the lamp body are electrically connected, for example, via a conductive wire. In addition, the fixing sleeve 18 and the first propping pin 16 are electrically connected via direct contact, such that the first propping pin 16 and the lamp body 03 are electrically connected.

Since the first propping pin 16 may be inevitably subject to damages, for example, poor contact between the first propping pin 16 and the first circuit board 14 due to insufficient elasticity of the elastic member 163, in this case the first propping pin 16 needs to be replaced or repaired. In the process of replacement or repair of the first propping pin 16, the first propping pin 16 may be removed from the fixing sleeve 18. In the process of removal of the first propping pin 16, the first propping pin 16 is taken out from the opening of the fixing sleeve 18. Since the first propping pin 16 and the lamp body 03 are not directly connected, the fixing sleeve 18 does not need to be removed and the electrical connection structure between the fixing sleeve 18 and the lamp body 03 does not need to be released. In this way, mounting and removal of the first propping pin 16 are more convenient.

It may be understood that the structure of mounting the second propping pin 17 on the fixing pin 13 is the same as that of mounting the first propping pin 16 on the lamp cap 12, and achieves the same effect, which is not described in the embodiments of the present application.

Figure 9:
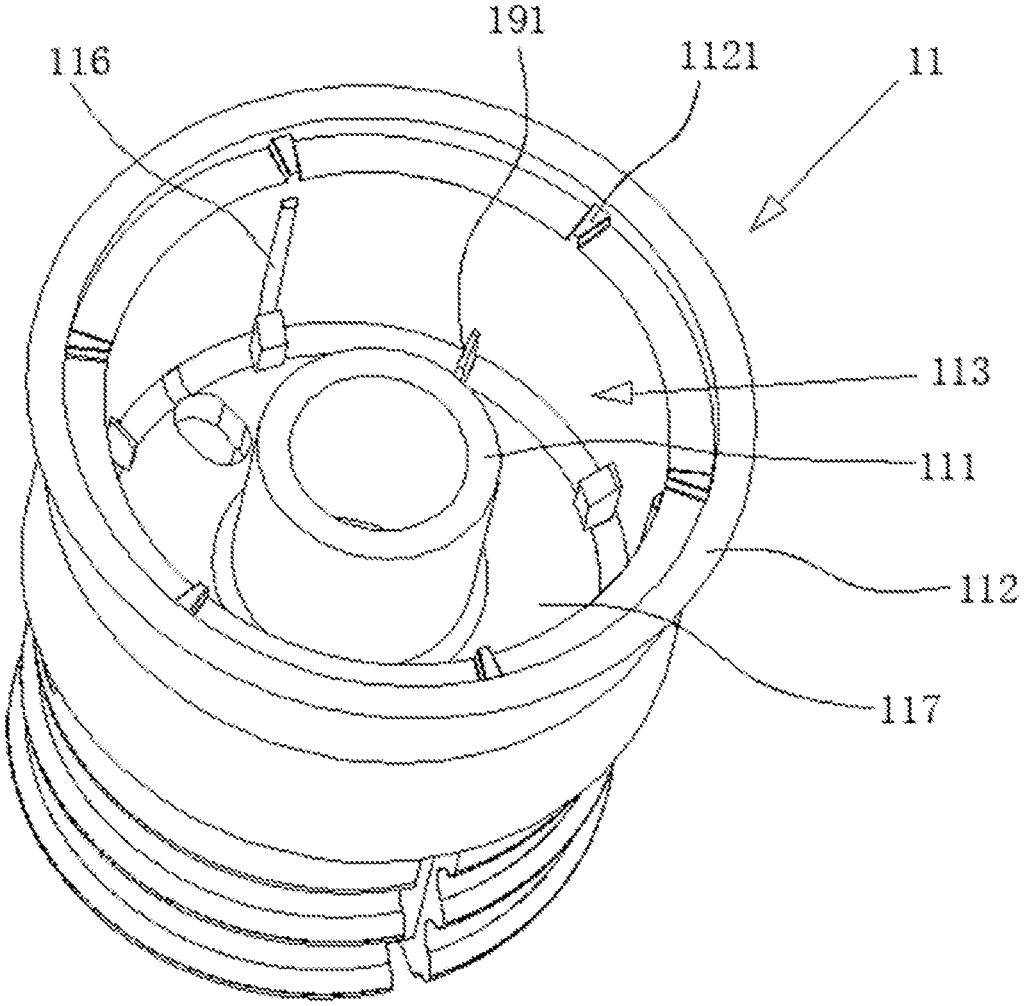
FIG. 9 is a schematic structural view of a lamp base neck at a first view angle according to an embodiment of the present application.
Figure 10:
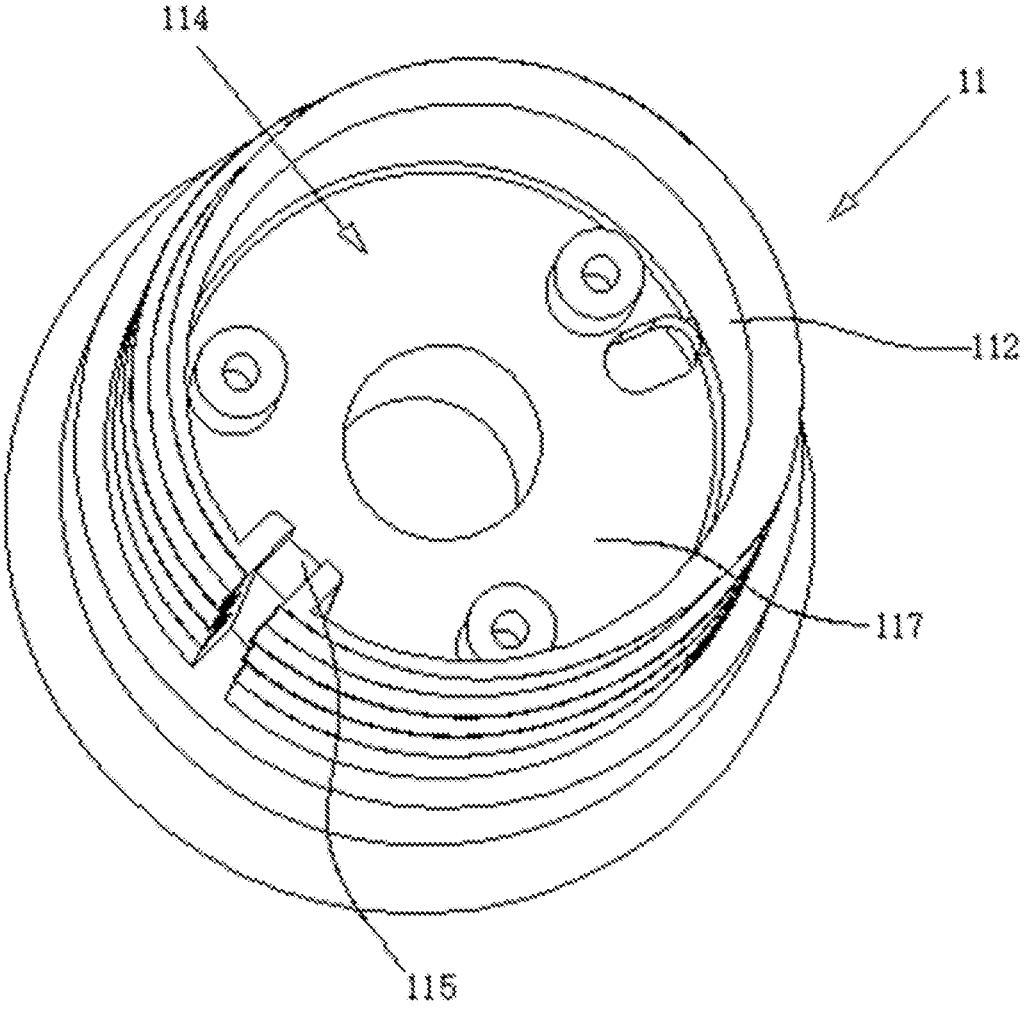
FIG. 10 is a schematic structural view of the lamp base neck at a second view angle according to an embodiment of the present application.

As illustrated in FIG. 9 and FIG. 10, FIG. 9 is a schematic structural view of the lamp base neck 11 at a first view angle according to an embodiment of the present application, and FIG. 10 is a schematic structural view of the lamp base neck 11 at a second view angle according to an embodiment of the present application. In some embodiments, the lamp base neck 11 is approximately columnar, an end, proximal to the lamp cap 12, of the bottom plate 117 is provided with an inner ring 111. An annular slot 113 is formed between the inner ring 111 and the side wall 112. The inner ring 111, the side wall 112, and the annular slot 113 are all coaxially disposed. The inner ring 111 is provided with an inner bore. The inner bore is configured to extend through the inner ring 111 and the bottom plate 117.

Figure 11:
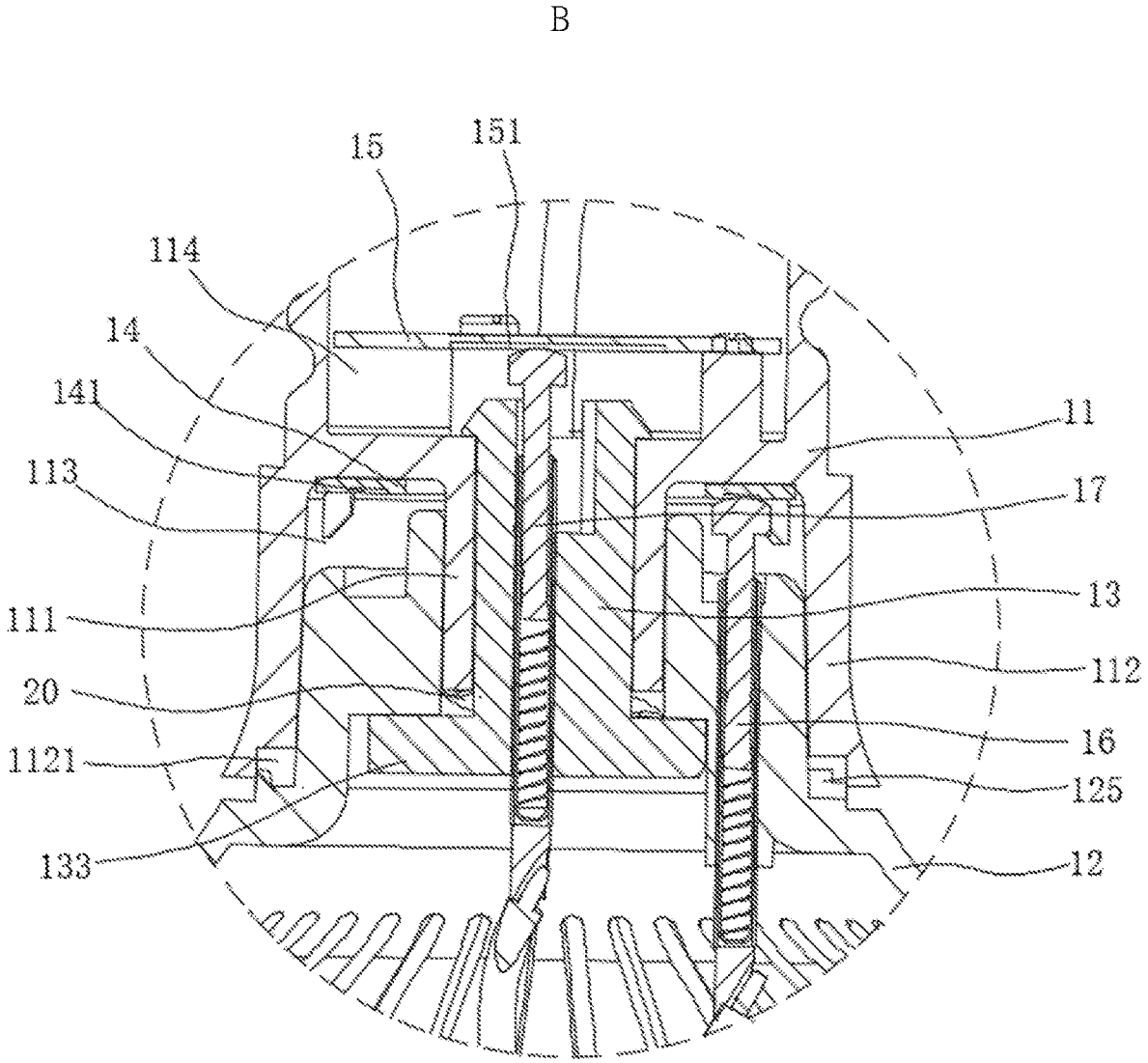
FIG. 11 is a schematic enlarged structural view of part B in FIG. 2.

As illustrated in FIG. 11, FIG. 11 is a schematic enlarged structural view of part B in FIG. 2. The fixing pin 13 is inserted into the inner bore of the inner ring 111. The first circuit board 14 is mounted in the annular slot 113. The first conductive region 141 of the first circuit board 14 faces towards the lamp cap 12. A circle center of the first conductive region 141 is disposed on the axis of the fixing pin 13.

As illustrated in FIG. 10 and FIG. 11, an end, facing away from the lamp cap 12, of the lamp base neck 11 is provided with an accommodation chamber 114. The inner bore of the inner ring 111 is in communication with the accommodation chamber 114. The accommodation chamber 114 is configured to accommodate the second circuit board 15. In the case that the second circuit board 15 is mounted in the accommodation chamber 114, the second conductive region 151 is rightly opposite to the inner bore of the annular ring 111. The second conductive region 151 may be circular, annular, elliptical, or the like, as long as it is ensured that in the case that the second propping pin 17 is mounted in fixing pin 13, the end portion of the second propping pin 17 is constantly abutted against the second conductive region 151 in the process of rotation. Optionally, in the case that the second conductive region 151 is circular, a circle center thereof is disposed on the axis of the fixing pin 13.

It should be noted that in the embodiments of the present application, the first circuit board 14 is more proximal to the lamp cap 12 than the second circuit board 15 is. However, in actual manufacture, the positions of the first circuit board 14 and the second circuit board 15 may be exchanged, which are not limited in the embodiments of the present application.

As illustrated in FIG. 4, FIG. 5, and FIG. 6, in some embodiments, the first circuit board 14 is provided with a connection hole 142-1 configured to be connected to the first wiring 21, and the second circuit board 15 is provided with a connection hole 142-2 configured to be connected to the second wiring 22. For protection of the first wiring 21 and the second wiring 22 from exposure outside, the first wiring 21 and the second wiring 22 are both configured to extend out from an end, distal from the lamp cap 12, of the lamp base neck 11 (as illustrated in FIG. 1). As such, in the case that the lamp base holder 01 is connected to the lamp base 02, the first wiring 21 and the second wiring 22 may be totally enclosed inside the lamp base neck 11.

However, in the case that the first wiring 21 extend out from the end, distal from the lamp cap 12, of the lamp base neck 11, the first wiring 21 needs to penetrate the second circuit board 15. In this case, as illustrated in FIG. 6, the second circuit board 15 is provided with an escape opening 152 for the first wiring 21 to penetrate. In addition, in order that the first wiring 21 penetrates the second circuit board 15 via a shortest path, as illustrated in FIG. 6 and FIG. 10, the lamp base neck 11 is provided with a locating block 115, and the second circuit board 15 is provided with a locating slot 153. The locating slot 153 is engaged with the locating block 115, such that the escape opening 152 is in communication with the connection hole 142-1 in the first circuit board 141. For example, the escape opening 152 is flush with the connection hole 142-1. Specifically, the locating block 115 is disposed on an inner wall of the accommodation chamber 114, and protrudes from a surface of the inner wall of the accommodation chamber 114. For example, the locating block 115 is strip-shaped, and disposed on the inner wall of the accommodation chamber 114 along an axis of the lamp base neck 11. In the process of mounting of the second circuit board 15, the locating slot 153 of the second circuit board 15 is sleeved onto the locating block 115, and slides along the locating block 115 and progressively approaches the bottom plate 117 before the second circuit board 15 is properly mounted, such that the escape opening 152 of the second circuit board 15 is flush with the connection hole 142-1 of the first circuit board 14, and the first wiring 21 connected to the connection hole 142-1 of the first circuit board 14 penetrates the escape opening 152 in a shortest path and runs through from the second circuit board 15.

Figure 12:
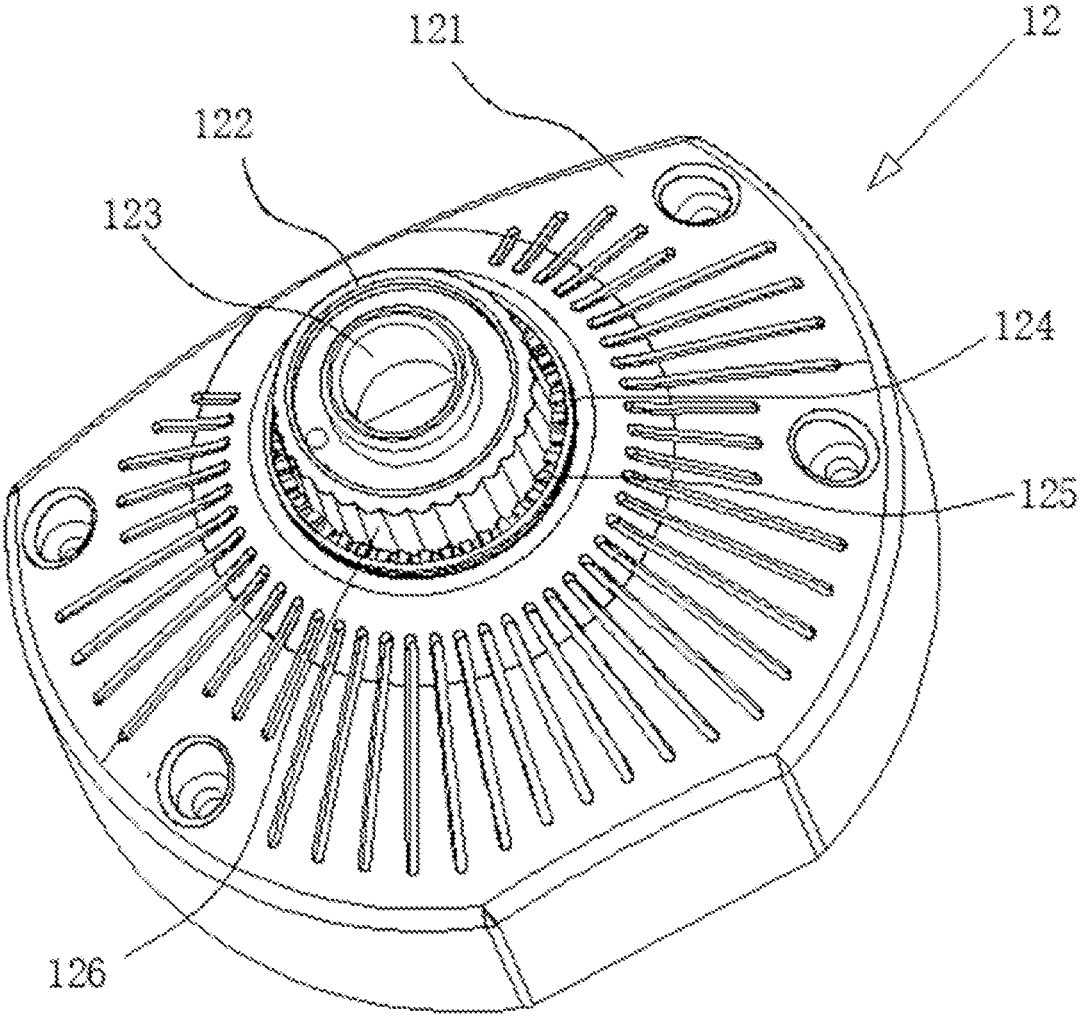
FIG. 12 is a schematic structural view of a lamp cap at a first view angle according to an embodiment of the present application.
Figure 13:
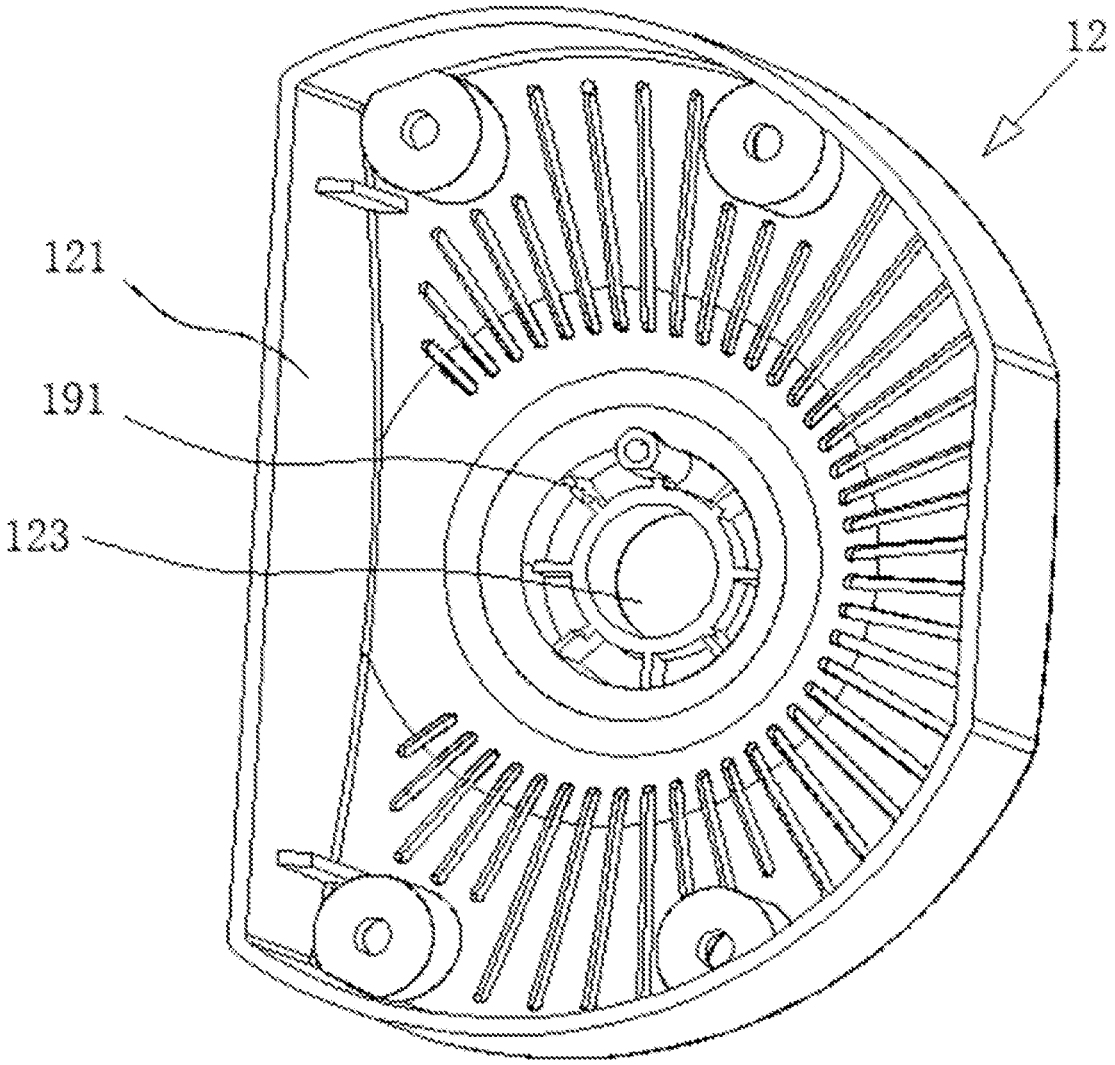
FIG. 13 is a schematic structural view of the lamp cap at a second view angle according to an embodiment of the present application.

As illustrated in FIG. 12 and FIG. 13, in some embodiments, the lamp cap 12 includes a housing portion 121 and a columnar portion 122. The housing portion 121 is configured to mount the lamp body 03. The columnar portion 122 protrudes from an outer wall of the housing portion 121. A center of the columnar portion 122 is provided with a through hole 123 along an axial direction of the columnar portion 122. An outer wall of the columnar portion 122 is in contact with an inner wall of the side wall 112 of the lamp base neck 11. The through hole 123 is in contact with the outer wall of the inner ring 111 of the lamp base neck 11. By this configuration, the columnar portion 122 of the lamp cap 12 and the lamp base neck 11 are coaxially disposed and are engaged with each other in a radial direction, which is conductive to rapid positioning between the lamp base neck 11 and the lamp socket in the process of mounting.

Figure 14:
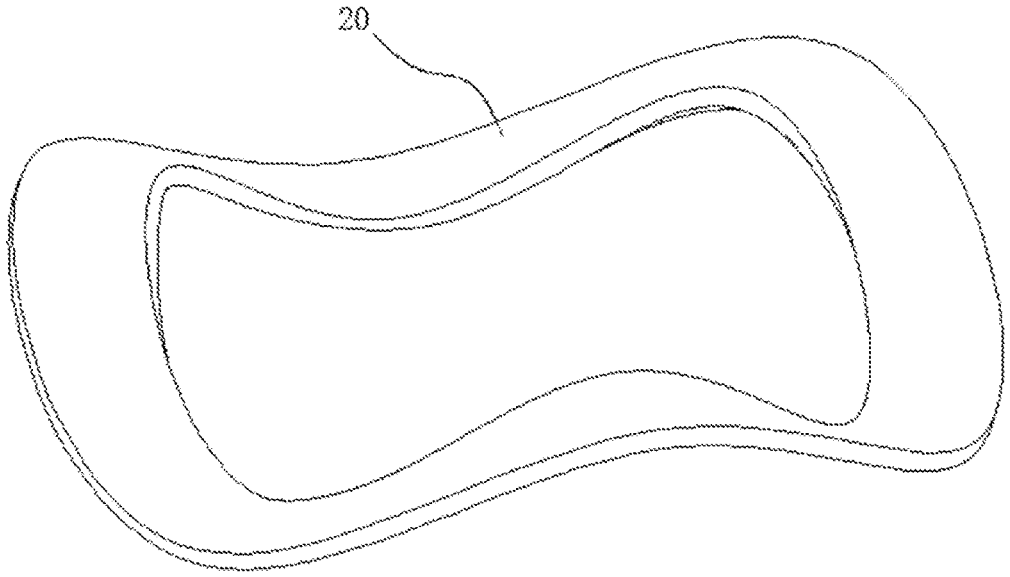
FIG. 14 is a schematic structural view of a fixing pin at a first view angle according to an embodiment of the present application.
Figure 15:
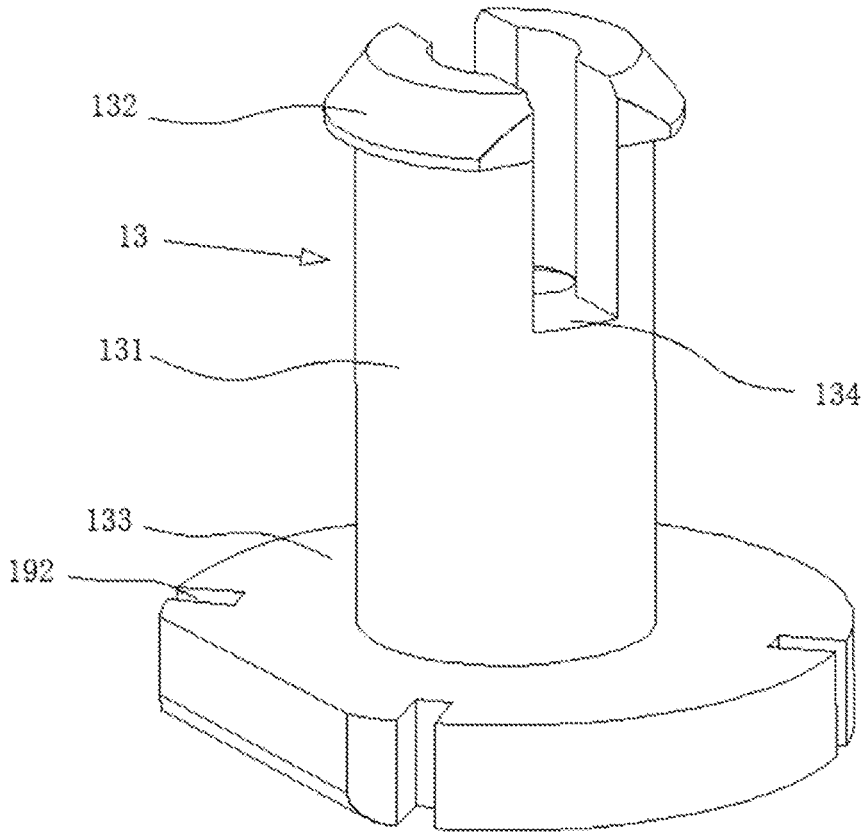
FIG. 15 is a schematic structural view of the fixing pin at a second view angle according to an embodiment of the present application.

As illustrated in FIG. 11, FIG. 14, and FIG. 15, FIG. 14 is a schematic structural view of the fixing pin 13 at a first view angle, and FIG. 15 is a schematic structural view of the fixing pin 13 at a second view angle. In some embodiments, the fixing pin 13 includes a post portion 131, a first stop portion 132 disposed on one end of the post portion 131, and a second stop portion 133 disposed on the other end of the post portion 131. The first stop portion 132 and the second stop portion 133 both protrude from an outer periphery of the post portion 131. The post portion 131 penetrates the inner bore of the inner ring 111. The first stop portion 132 is abutted against an end, distal from the lamp cap 12, of the inner bore of the inner ring 111, and is configured to restriction axial movement of the lamp base neck 11 along the fixing pin 13. The second stop portion 133 is abutted against one end, distal from the lamp base neck 11, of the through hole 123, and is configured to restrict axial movement of the lamp cap 12 along the fixing pin 13. The first stop portion 132 and the second stop portion 133 are engaged with each other, such that the lamp base neck 11 and the lamp cap 12 are connected and fixed to each other.

Exemplarily, the fixing pin 13 is a cylindrical plastic fixing pin. The second stop portion 133 is cake-shaped, and a maximum diameter of the second stop portion 133 is greater than a diameter of the through hole 123. The first stop portion 132 is umbrella-shaped, and a maximum diameter of the first stop portion 132 is greater than a diameter of the inner bore of the inner ring 111. In addition, a stress slot 134 is disposed in a middle portion of the first stop portion 132 along an axial direction thereof. The stress slot 134 divides the first stop portion 132 into two parts along the axial direction. Nevertheless, the first stop portion 132 may also be divided into more parts, which is not limited in the embodiments of the present application. A mounting hole configured to mount the second propping pin 17 is disposed in the fixing pin 13 along an axial direction of the fixing pin 13. The second propping pin 17 is mounted in the mounting hole via the fixing sleeve 18, and one end of the second propping pin 17 is abutted against the second conductive region 151 of the second circuit board 15. The remaining mounting structure of the second propping pin 17 is the same as the mounting structure of the first propping pin 16 on the lamp cap 12, which is not limited in the embodiments of the present application.

It should be noted that since the second propping pin 17 is mounted on the fixing pin 13, to cause the second propping pin 17 to rotate with the lamp cap 12, the fixing pin 13 needs to be caused to rotate with the lamp cap 12. For implementation of this function, in the embodiments of the present application, a locking mechanism is disposed between the fixing pin 13 and the lamp cap 12.

As illustrated in FIG. 13, FIG. 14, and FIG. 15, in some embodiments, the locking mechanism includes a boss 191 disposed on the lamp cap 12, and a recess 192 is disposed on an edge of the first stop portion 132. The recess 192 is configured to be fitted with the boss 191 to restrict a relative position between the fixing pin 13 and the lamp cap 12 in a circumferential direction, such that the fixing pin 13 and the lamp cap 12 synchronously rotate. In this way, the second propping pin 17 is driven to rotate with the lamp cap 12 and the lamp body 03, such that twisting of the wire for electrically connecting the lamp body 03 and the second propping pin 17 is prevented in the process of rotation of the lamp cap 12 relative to the lamp base neck 11.

In some other embodiments, the locking mechanism may further include a screw. The screw is inserted into the lamp cap 12 and the fixing pin 13 successively, such that the fixing pin 13 and the lamp cap 12 synchronously rotate to drive the first propping pin 16 to rotate with the lamp cap 12 and the lamp body 03.

As illustrated in FIG. 9 and FIG. 12, in some embodiments, a periphery of the columnar portion 122 is provided with a turn of lamp cap locking teeth 126, and the inner wall of the side wall 112 is provided with one or more lamp base locking teeth 116. Each of the one or more lamp base locking teeth 116 is meshed with at least two of the lamp cap locking teeth 126 such that a rotation angle of the lamp base neck 11 relative to the lamp cap 12 is locked. Exemplarily, in the case that 360 lamp cap locking teeth 126 are disposed, a top portion of each of the lamp cap locking teeth 126 defines a connection surface with a central axis of the columnar portion 122, and an included angle of 1 degree is defined between two adjacent connection surfaces. Three lamp base locking teeth 116 are disposed, and an included angle defined between two adjacent lamp base locking teeth 116 is an integer multiple of an included angle defined between two adjacent lamp cap locking teeth 126. In a locked state, each of the lamp base locking teeth 116 is embedded into a valley between two adjacent lamp cap locking teeth 126, such that the lamp base neck 11 and the lamp cap 12 are positioned. At this time, in the case that the lamp base neck 11 is fixed, the lamp cap 12 is rotated clockwise or counterclockwise by 1 degree. In the process of rotation, the lamp base locking tooth 116 slides from an initial position to a valley proximal to the other side of one lamp cap locking tooth 126, such that the lamp base locking tooth 116 is positioned at another position. Accordingly, in the process of rotation of the lamp cap 12, the lamp cap 12 is positioned at the valley each time the lamp cap 12 is rotated by 1 degree, and the lamp cap 12 and the lamp base neck 11 may be positioned at a maximum of 360 positions.

It should be noted that to cause the lamp cap 12 to rotate under an external force, surfaces of the lamp base locking teeth 116 and the lamp cap locking teeth 126 are smooth. For example, protruded surfaces of the lamp base locking teeth 116 and the lamp cap locking teeth 126 are arc-shaped, such that it is sufficient to position the lamp base locking teeth 116 into a valley between adjacent lamp cap locking teeth 126 with no external force being applied. In the case that an external force is applied, a resistance against abutment between the top portions of the lamp cap locking teeth 126 and the lamp base locking teeth 116 is overcome, such that the lamp base locking teeth 116 rotate to a valley between another two lamp cap locking teeth 126.

As illustrated in FIG. 11 and FIG. 12, in some embodiments, an outer peripheral surface of the columnar portion 122 is fitted, via a tapered surface, with an inner peripheral surface of the side wall 112. A smaller-diameter end of the tapered surface is proximal to the lamp base neck 11, a larger-diameter end of the tapered surface is proximal to the lamp cap 12, and the lamp cap locking teeth 126 and the lamp base locking teeth 116 both extend along a generatrix of the tapered surface.

In the case that the lamp base neck 11 and the lamp cap 12 go away from each other, a distance between the outer peripheral surface of the columnar portion 122 and the inner peripheral surface of the side wall 112 increases, such that the lamp cap locking teeth 126 and the lamp base locking teeth 116 are in clearance fit or transition fit with each other, and the lamp base neck 11 and the lamp cap 12 may rotate relative to each other under effect of a first external force. The first external force refers to a rotation force acted on the lamp base neck 11 or the lamp cap 12 and surrounding the axis of the fixing pin 13.

In the case that the lamp base neck 11 and the lamp cap 12 approach each other, the distance between the outer peripheral surface of the columnar portion 22 and the inner peripheral surface of the side wall 112 decreases, such that the lamp cap locking teeth 126 and the lamp base locking teeth 116 approach to each other and are in close fit with each other to lock the rotation angle of the lamp cap 12 relative to the lamp base neck 11. In this way, the lamp base neck 11 and the lamp cap 12 are fixed relative to each other, and are capable of synchronously rotating under effect of the first external force to mount the lamp base holder 01 onto the lamp socket, or remove the lamp base holder 01 from the lamp socket.

As illustrated in FIG. 11, in some embodiments, an elastic washer 20 is disposed between the fixing pin 13 and the lamp base neck 11. The elastic washer 20 is in elastic contact with both the fixing pin 13 and the lamp base neck 11. Specifically, the elastic washer 20 is disposed between the second stop portion 133 and an end portion of the inner ring 111. The second stop portion 133 is abutted against the end portion of the inner ring 111 via the elastic washer 20, such that an elastic clearance is present between the second stop portion 133 and the end portion of the inner ring 111. In a pre-compressed state, the elastic washer 20, by a pre-compress elastic force, causes the lamp base neck 11 and the lamp cap 12 to go away from each other, such that the lamp cap locking teeth 126 and the lamp cap locking teeth 116 are in clearance fit or transition fit with each other, which facilitates relative rotation between the lamp cap 12 and the lamp base neck 11. In the case that the elastic washer 20 is further compressed by an external force, the elastic washer 20 is deformed such that parts disposed on two sides of the elastic washer 20 approach each other. For example, in the case that the elastic washer 20 is extruded and pressed by the lamp base neck 11 and the lamp cap 12, the elastic washer 20 is deformed to cause the lamp base neck 11 and the lamp cap 12 to approach each other.

Figure 16:
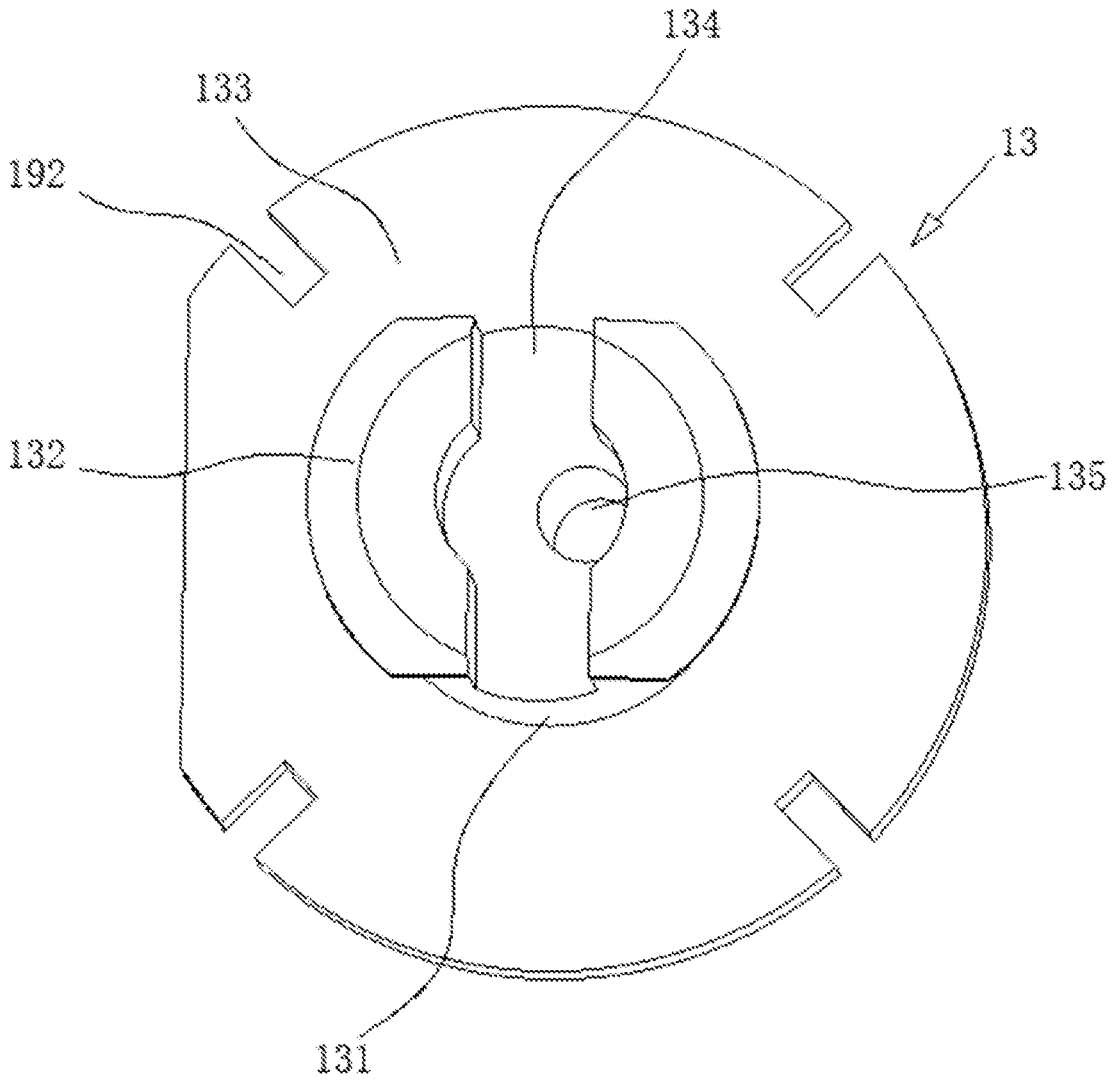
FIG. 16 is a schematic structural view of an elastic washer according to an embodiment of the present application.

As illustrated in FIG. 16, in some embodiments, the elastic washer 20 is a wave washer, such that a greater elastic deformation for adjusting fitting degree between the lamp cap locking teeth 126 and the lamp base locking teeth 116 may be generated in a direction parallel to an axis of the elastic washer 20.

In some embodiments, at least one of a surface, in contact with the second stop portion 133, of the elastic washer 20, and a surface, in contact with the end portion of the inner ring 111, of the elastic washer 20 is provided with an anti-skid pattern. The anti-skid pattern is configured to further increase friction between the elastic washer 20 and at least one of the second stop portion 133 and the end portion of the inner ring 111. Since the fixing pin 13 and the lamp cap 12 synchronously rotate, only in the case that a greater first external force is applied, the lamp cap 12 and the lamp base neck 11 are capable of rotating relative to each other to adjust the angle of the lamp body 03. Without the first external force or with a small first external force, the angle between the lamp cap 12 and the lamp base neck 11 is relatively fixed, such that the lamp body 03 is stably maintained at the desired angle, thereby preventing unnecessary rotation.

Exemplarily, the anti-skid pattern may be a grid pattern, a strip-shaped pattern, a sanded cover, or the like, which is not limited in the embodiments of the present application.

The implementation principles of the embodiments of the present application are as follows: Since the lamp base holder 01 includes the lamp base neck 11 and the lamp cap 12 that are separated from each other, and the lamp base neck 11 and the lamp cap 12 are rotatable relative to each other about the fixing pin 13, in the case that the lamp base neck 11 is connected to the lamp socket and the lamp cap 12 is connected to the lamp body 03, the angle of the lamp body 03 may be changed by rotating the lamp cap 12, such that a light-emitting surface of the lamp body 03 faces a desired direction. In addition, the electrical connection between the lamp base neck 11 and the lamp cap 12 is implemented by abutment of the first propping pin 16 against the first conductive region 141 and abutment of the second propping pin 17 against the second conductive region 151, instead of the electrical connection via the conductive wire in the related art. Therefore, the lamp cap 12 is rotatable at any angle relative to the lamp base neck 11, and twisting and break of the conductive wire are not caused.

The angle between the lamp base neck 11 and the lamp cap 12 may be locked by engagement between the lamp cap locking teeth 126 disposed on the outer periphery of the columnar portion 122 and the lamp base locking teeth 116 disposed on the inner wall of the side wall 112. Under effect of the elastic force of the elastic washer 20, the lamp base neck 11 and the lamp cap 12 are in clearance fit or transition fit with each other, and the first external force is applied to rotate the lamp cap 12, such that the lamp cap 12 rotates at an angle of one or a plurality of lamp cap locking teeth 126 relative to the lamp base neck 11. Afterwards, the first external force is removed, and the lamp cap locking teeth 126 and the lamp base locking teeth 116 are in fit with each other at the angle, such that the angle between the lamp base neck 11 and the lamp cap 12 is locked.

Further, the angle between the lamp base neck 11 and the lamp cap 12 may also be locked by the anti-skid pattern on the surface of the elastic washer 20. In the case that the first external force is applied to the lamp cap 12, the lamp cap 12 overcomes the friction of the anti-skid pattern and rotates relative to the lamp base neck 11 to a suitable angle. Afterwards, the first external force is removed, and under effect of the friction of the anti-skid pattern, the lamp cap 12 and the lamp base neck 11 are stably maintained at the adjusted position, with no severe rotation or shaking.

It should be emphasized that in the process of actual process of rotating the lamp cap 12, the rotation angel is not necessarily sufficiently accurate, as long as the light-emitting surface of the lamp body 03 approximately rotates to the desired direction.

The above two fashions for locking the angle between the lamp base neck 11 and the lamp cap 12 may be independently used or combined in use, which is not limited in the embodiments of the present application.

During use, the lamp base holder 01 also needs to be mounted, typically, by threaded connection, onto the lamp socket 02 together with the lamp body 03. When the lamp cap 12 and the lamp base neck 11 are rotatable relative to each other, it is difficult for an operator to hold the lamp cap 12 and screw up the lamp base holder 01 onto the lamp socket 02, and removal of the lamp base holder 01 is also difficult. Therefore, in the process of mounting or removal of the lamp base holder 01, the lamp cap 12 and the lamp base neck 11 need to be maintained stably, without any relative rotation.

Figure 17:
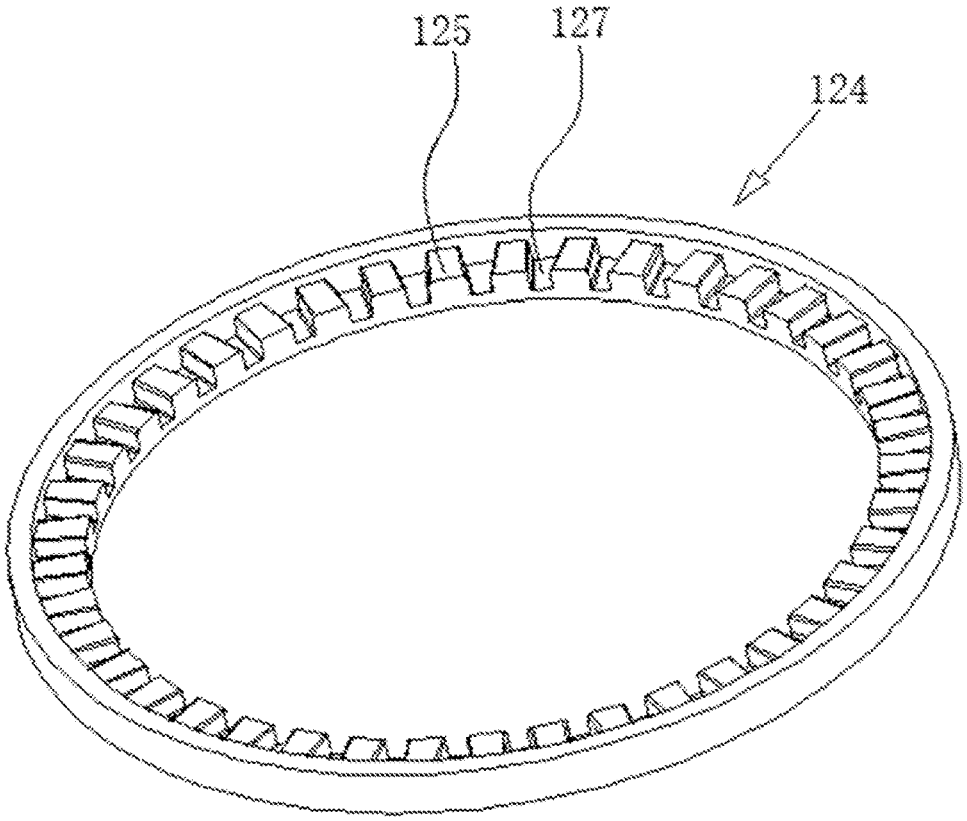
FIG. 17 is a schematic structural view of a toothed ring to an embodiment of the present application.

As illustrated in FIG. 9, FIG. 12, and FIG. 17, in some embodiments, the housing portion 121 is provided with a toothed ring 124 surrounding the columnar portion 122. An end portion of the side wall 112 is abutted against the toothed ring 124. A side, proximal to the lamp base neck 11, of the toothed ring 124 is provided with a turn of end-face teeth 125, and the end portion of the side wall 112 of the lamp base neck 11 is provided with a restraining block 1121. Therefore, in the process of mounting or removal of the lamp base holder 01, the lamp cap 12 and the lamp base neck 11 are maintained stably relative to each other, without any relative rotation.

Exemplarily, as illustrated in FIG. 17, the end-face teeth 125 are arranged circumferentially along the toothed ring 124, and a restraining groove 127 is defined between two adjacent end-face teeth 125. The restraining grooves 127 have an equal width, and each two adjacent restraining grooves 127 have an equal distance therebetween. As illustrated in FIG. 9, six restraining blocks 1121 are disposed. The six restraining blocks 1121 are uniformly and circumferentially arranged on the end portion of the side wall 112. The shape of the restraining block 1121 is adaptive to the shape of the restraining groove 127 to be engaged with the restraining groove 127. In this way, the lamp base neck 11 and the lamp cap 12 are locked. It should be noted that configuration of the restraining block 1121 needs to satisfy a requirement that the six restraining blocks 1121 are simultaneously adaptive to the restraining grooves 127 such that the six restraining blocks 1121 collaboratively define a relative position between the lamp base neck 11 and the lamp cap 12.

When only one restraining block 1121 is disposed, the restraining block 1121 only needs to be adaptive to any of the restraining grooves 127.

In the case that a second external force is applied such that the lamp base neck 11 and the lamp cap 12 approach each other, a top surface of the restraining block 1121 progressively approaches the restraining groove 127 defined between two adjacent end-face teeth 125, and is adaptive to the restraining groove 127. Two sides of the restraining block 1121 along a circumferential direction are both provided with end-face teeth 125, and the end-face teeth 125 restricts circumferential movement of the restraining block 1121, such that in the process of rotation of the lamp cap 12, due to restriction from the end-face teeth 125 and the restraining block 1121, the lamp base neck 11 and the lamp cap 12 fails to move relative to each other. In this way, the lamp base neck 11 and the lamp cap 12 are locked together, such that the lamp base neck 11 and the lamp cap 12 synchronously rotate under effect of the first external force to mount the lamp base holder 01 onto the lamp socket, or remove the lamp base holder 01 from the lamp socket. The second external force refers to a force acting on the lamp cap 12 to cause the lamp cap 12 to approach the lamp base neck 11 along the axis of the fixing pin 13.

In the case that the lamp base holder 01 is mounted or removed, the second external force is removed. In this case, under effect of the elastic force of the elastic washer 20, the lamp base neck 11 and the lamp cap 12 goes away from each other, the restraining block 1121 and the end-face teeth 125 are separated from each other and disengaged from each other, such that the lamp base neck 11 and the lamp cap 12 rotate relative to each other under effect of the first external force to adjust the angle of the lamp body 03.

Figure 18:
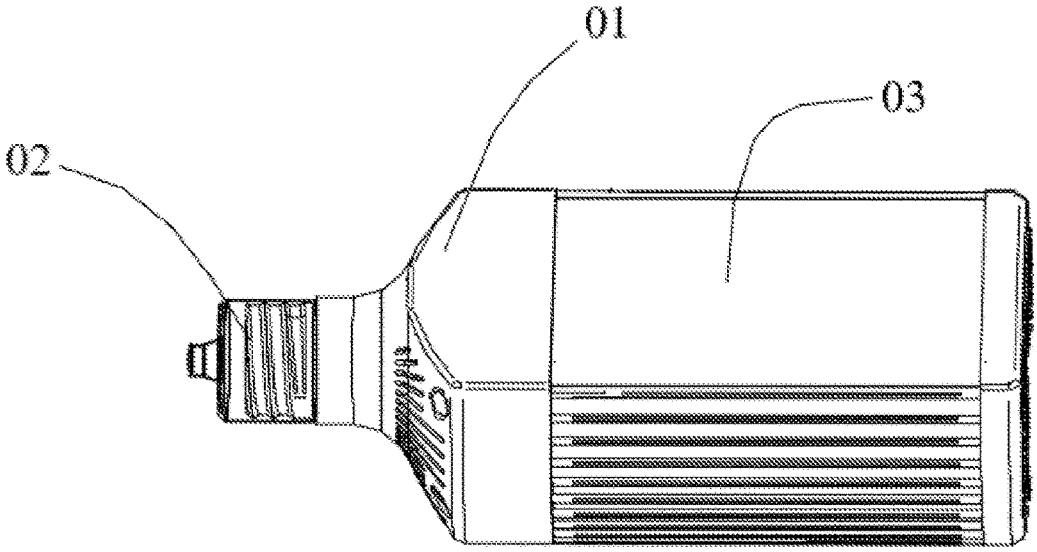
FIG. 18 is a schematic structural view of a lamp according to an embodiment of the present application.

An embodiment of the present application further provides a lamp, particularly an LED lamp. As illustrated in FIG. 18, the lamp according to this embodiment includes a lamp base 02, a lamp body 03, and the lamp base holder 01 as described in the above embodiments. An outer wall of a lamp base neck 11 of the lamp base holder 01 is provided with male threads. The lamp base 02 is provided with male threads and female threads. The male threads are engaged with a lamp socket to receive power, and the female threads are engaged with the male threads of the lamp base neck 11. The lamp body 03 is fixed onto the lamp cap 12 of the lamp base holder 01.

In some embodiments, the lamp base 02 is electrically connected to the lamp base holder 01, and the lamp base holder 01 is electrically connected to the lamp socket via the lamp base 02. For example, the first wiring 21 and the second wiring 22 of the lamp base holder 01 are respectively electrically connected to two conductive portions of the lamp base 02. For example, the two conductive portions are respectively a metal head and a metal wall of the lamp base 02. The metal head and the metal wall of the lamp base 02 are respectively configured to be connected to an L wire and an N wire of the lamp socket, such that the lamp body 03 is connected to the circuit and thus the lamp body 03 emits light.

The lamp body 03 of the lamp according to the embodiments of the present application may be rotated to any desired angle according to actual needs, and twisting and break of the conductive wire are not caused.

An embodiment of the present application further provides a method for adjusting an angle of a lamp body. The method is applicable to the lamp according to the above embodiments. The method includes: rotating the lamp cap 12 about an axis of the fixing pin 13, such that the lamp body 03, the first propping pin 16, and the second propping pin 17 rotate with the lamp cap 12, and in the process of rotation of the lamp cap 12 relative to the lamp base neck 11, one end of the first propping pin 16 is constantly abutted against the first conductive region 141, and the other end of the second propping pin 17 is constantly abutted against the second conductive region 151.

According to the embodiments of the present application, a lamp base neck 11 and a lamp cap 12 that are rotatable relative to each other are disposed, a first circuit board 14 and a second circuit board 15 are disposed on the lamp base neck 11, the first circuit board 14 is provided with a first conductive region 141, the second circuit board 15 is provided with a second conductive region 151, a first propping pin 16 and a second propping pin 17 that are configured to be rotatable with the lamp cap 12, the first propping pin 16 is abutted against the first conductive region 141 to achieve electrical connection, the second propping pin 17 is abutted against the second conductive region 151 to achieve electrical connection. In this way, the lamp cap 12 is rotatable to any desired angle relative to the lamp base neck 11 to adjust an angle of a lamp body 03, and no conductive wire needs to be used between the lamp cap 12 and the lamp base neck 11, such that twisting and break of the conductive wire are prevented in the process of rotation of the lamp cap 12.

In addition, those skilled in the art shall understand that a combination of the features in different embodiments signifies that the features are within the scope of the present application and different embodiments may be derived. For example, in the claims appended hereinafter, any one of the embodiments for which protection is sought may be practiced in any combination manner.

In summary, it should be finally noted that the above-described embodiments are merely for illustration of the present application, but are not intended to limit the present application. Although the present application is described in detail with reference to these embodiments, a person skilled in the art may also make various modifications to the technical solutions disclosed in the embodiments, or make equivalent replacements to a part of the technical features contained therein. Such modifications or replacements, made without departing from the principles of the present application, shall fall within the scope of the present application.

What is claimed is:

1. A lamp base holder, comprising a lamp base neck, a lamp cap, and a fixing pin; wherein the lamp cap is configured to mount a lamp body, and the fixing pin respectively penetrates the lamp base neck and the lamp cap to connect the lamp base neck to the lamp cap and the lamp cap rotates relative to the lamp base neck by using the fixing pin;

the lamp base neck comprises a bottom plate and a side wall surrounding a circumference of the bottom plate, wherein the bottom plate is arranged opposite to the lamp cap, and the side wall is configured to be connected to a lamp base;

the lamp base neck is provided with a first circuit board and a second circuit board, wherein the first circuit board is arranged on a side, facing the lamp cap, of the bottom plate, and the second circuit board is arranged on a side, distal from the lamp cap, of the bottom plate;

wherein the first circuit board is provided with a first conductive region and the second circuit board is provided with a second conductive region, wherein the first circuit board is connected to a first wiring via the first conductive region, and the second circuit board is connected to a second wiring via the second conductive region, one of the first wiring and the second wiring is configured to be connected to an L wire of a power source, and the other one of the first wiring and the second wiring is connected to an N wire of the power source, such that the lamp body is connected to circuitry to cause the lamp body to be capable of emitting light;

the lamp cap is provided with a first propping pin, wherein one end of the first propping pin is electrically connected to the lamp body, and the other end of the first propping pin penetrates the lamp cap and is configured to be electrically connected to the first conductive region, the first propping pin is rotatable with the lamp cap, and in a process of rotation of the lamp cap relative to the lamp base neck, the other end of the first propping pin is constantly abutted against the first conductive region; and the fixing pin is internally provided with a second propping pin along an axis of the fixing pin, wherein one end of the second propping pin is electrically connected to the lamp body, and the other end of the second propping pin protrudes from the fixing pin and is configured to be electrically connected to the second conductive region, and in the process of rotation of the lamp cap relative to the lamp base neck, the other end of the second propping pin is constantly abutted against the second conductive region.

2. The lamp base holder according to claim 1, wherein at least one of the first conductive region and the second conductive region is circular or annular, and circle centers of the first conductive region and the second conductive region are disposed on the axis of the fixing pin.

3. The lamp base holder according to claim 1, wherein the second circuit board is provided with an escape opening allowing the first wiring to penetrate.

4. The lamp base holder according to claim 3, wherein the first circuit board is provided with a connection hole configured to be connected to the first wiring, and the lamp base neck is provided with a locating block, the second circuit board is provided with a locating slot, and the locating slot is engaged with the locating block such that the escape opening is in communication with the connection hole in the first circuit board.

5. The lamp base holder according to claim 1, wherein the lamp base neck further comprises an inner ring disposed on an inner side of the side wall and an annular slot disposed between the inner ring and the side wall, wherein the inner ring is disposed on a side, proximal to the lamp cap, of the bottom plate, the inner ring is provided with an inner bore, the inner bore extends through the inner ring and the bottom plate, the first circuit board is disposed in the annular slot, and the inner bore of the inner ring is configured to allow the fixing pin to be inserted therein.

6. The lamp base holder according to claim 5, wherein the lamp cap comprises a housing portion, and a columnar portion, wherein the housing portion is configured to accommodate the lamp body, the columnar portion protrudes from an outer wall of the housing portion, a through hole is disposed at a center of the columnar portion, and an outer wall of the columnar portion is engaged with an inner wall of the side wall, and the through hole is engaged with an outer wall of the inner ring.

7. The lamp base holder according to claim 6, wherein the housing portion is provided with a toothed ring surrounding the columnar portion, and an end portion of the side wall is abutted against the toothed ring; wherein the toothed ring is provided with a turn of end-face teeth, and the end portion of the side wall is provided with a restraining block, and the restraining block is engaged with the end-face teeth to lock a rotation angle of the lamp cap relative to the lamp base neck; wherein the lamp cap is rotatable relative to the lamp base neck in the case that the restraining block is disengaged from the end-face teeth.

8. The lamp base holder according to claim 6, wherein a periphery of the columnar portion is provided with a turn of lamp cap locking teeth, and an inner wall of the side wall is provided with lamp base locking teeth; wherein the lamp base locking teeth are meshed with the lamp cap locking teeth such that a rotation angle of the lamp cap relative to the lamp base neck is locked.

9. The lamp base holder according to claim 8, wherein an outer peripheral surface of the columnar portion is fitted, via a tapered surface, with an inner peripheral surface of the side wall; wherein a smaller-diameter end of the tapered surface is proximal to the lamp base neck, a larger-diameter end of the tapered surface is proximal to the lamp cap, and the lamp cap locking teeth and the lamp base locking teeth both extend along a generatrix of the tapered surface.

10. The lamp base holder according to claim 5, wherein the fixing pin comprises a post portion, a first stop portion disposed on one end of the post portion, and a second stop portion disposed on the other end of the post portion; wherein the first stop portion and the second stop portion both protrude from an outer periphery of the post portion, the post portion penetrates the inner bore of the inner ring, the first stop portion is disposed on an end, distal from the lamp cap, of the inner bore of the inner ring, and the second stop portion is disposed on an end, distal from the lamp base neck, of the through hole.

11. The lamp base holder according to claim 10, wherein a locking mechanism is disposed between the fixing pin and the lamp cap, and is configured to cause the fixing pin to rotate with the lamp cap.

12. The lamp base holder according to claim 11, wherein the locking mechanism comprises a boss disposed on the lamp cap and a recess disposed on an edge of the first stop portion; wherein the recess is fitted with the boss.

13. The lamp base holder according to claim 1, further comprising an elastic washer, wherein the elastic washer is disposed between the fixing pin and the lamp base neck, and is in elastic contact with the fixing pin and the lamp base neck.

14. The lamp base holder according to claim 13, wherein the elastic washer is a wave washer.

15. The lamp base holder according to claim 13, wherein at least one of a surface, in contact with the fixing pin, of the elastic washer, and a surface, in contact with the lamp base neck, of the elastic washer is provided with an anti-skid pattern.

16. The lamp base holder according to claim 1, wherein the first propping pin comprises a first section and a second section that are coaxially connected; wherein a conductive elastic member is disposed between the first section and the second section.

17. The lamp base holder according to claim 16, further comprising a conductive fixing sleeve; wherein the first propping pin is mounted in the fixing sleeve, and the first propping pin is electrically connected to the lamp body via the fixing sleeve.

18. The lamp base holder according to claim 1, wherein an end portion surface, in contact with the first conductive region, of the first propping pin is designed as a smooth curved surface.

19. A lamp, comprising a lamp base, a lamp body, and the lamp base holder as defined in claim 1; wherein an exterior of the side wall of the lamp base neck of the lamp base holder is provided with male threads;

the lamp base is provided with male threads and female threads, wherein the male threads are engaged with a lamp socket to receive power, and the female threads are engaged with the male threads of the lamp base neck; and the lamp body is fixed to the lamp cap of the lamp base holder.

20. A method for adjusting an angle of the lamp body of the lamp as defined in claim 19, the method comprising:

rotating the lamp cap about the axis of the fixing pin, such that the lamp body, the first propping pin, and the second propping pin rotate with the lamp cap, and during rotation of the lamp cap relative to the lamp base neck, one end of the first propping pin is constantly abutted against the first conductive region, and the other end of the second propping pin is constantly abutted against the second conductive region.

* * * * *